US009747919B2

(12) United States Patent
Matsuo

(10) Patent No.: US 9,747,919 B2
(45) Date of Patent: Aug. 29, 2017

(54) SOUND PROCESSING APPARATUS AND RECORDING MEDIUM STORING A SOUND PROCESSING PROGRAM

(75) Inventor: Naoshi Matsuo, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 917 days.

(21) Appl. No.: 13/324,297

(22) Filed: Dec. 13, 2011

(65) Prior Publication Data

US 2012/0155674 A1 Jun. 21, 2012

(30) Foreign Application Priority Data

Dec. 17, 2010 (JP) ..... 2010-282436

(51) Int. Cl.

| | |
|---|---|
| ***G10L 21/0208*** | (2013.01) |
| ***H04R 3/00*** | (2006.01) |
| *G10L 21/0224* | (2013.01) |
| *G10L 21/0216* | (2013.01) |
| *H04R 5/00* | (2006.01) |

(52) U.S. Cl.

CPC ..... *G10L 21/0208* (2013.01); *H04R 3/005* (2013.01); *G10L 21/0224* (2013.01); *G10L 2021/02165* (2013.01); *H04R 5/00* (2013.01)

(58) Field of Classification Search

CPC . H03H 21/0012; G10L 21/0208; H04M 9/082
USPC ..... 381/92, 94.1–94.3, 94.7
See application file for complete search history.

(56) References Cited

U.S. PATENT DOCUMENTS 4,489,442 A 12/1984 Anderson et al.
5,208,864 A * 5/1993 Kaneda ..... G10L 25/78 381/122
8,300,846 B2 10/2012 Kim et al.
2003/0177007 A1 9/2003 Kanazawa et al.
2007/0154031 A1 7/2007 Avendano et al.
2007/0237339 A1* 10/2007 Konchitsky ..... H04M 9/08 381/91
2008/0285770 A1* 11/2008 Wu ..... H04R 1/406 381/92

(Continued)

FOREIGN PATENT DOCUMENTS

GB 2398913 A 9/2004
JP 57-148413 A 9/1982

(Continued)

OTHER PUBLICATIONS

Boll, Steven F. et al., "Suppression of Acoustic Noise in Speech Using Spectral Subtraction", IEEE Transactions on Acoustics, Speech, and Signal Processing, vol. ASSP-27, No. 2 Apr. 1979, pp. 113-120.

(Continued)

*Primary Examiner* — George Monikang

(74) *Attorney, Agent, or Firm* — Oblon, McClelland, Maier & Neustadt, L.L.P.

(57) ABSTRACT

A sound processing apparatus includes a first calculator that calculates first power based on a first signal received by a first microphone that is among the first microphone and a second microphone; a second calculator that calculates second power based on a second signal received by the second microphone; a gain calculator that calculates a gain on the basis of the ratio of the first power to the second power; and a multiplier that processes the second signal using the gain calculated by the gain calculator.

15 Claims, 14 Drawing Sheets

(56) References Cited

U.S. PATENT DOCUMENTS

| | | | | |
|---|---|---|---|---|
| 2009/0055170 | A1 | 2/2009 | Nagahama | |
| 2009/0076810 | A1* | 3/2009 | Matsuo | H03G 3/32 704/225 |
| 2009/0175466 | A1 | 7/2009 | Elko et al. | |
| 2010/0061568 | A1* | 3/2010 | Rasmussen | H04R 3/005 381/94.1 |

FOREIGN PATENT DOCUMENTS

| | | | |
|---|---|---|---|
| JP | 59-74800 | A | 4/1984 |
| JP | 61-161896 | A | 7/1986 |
| JP | 11-249693 | | 9/1999 |
| JP | 2003-271191 | A | 9/2003 |
| WO | WO-2007/018293 | | 2/2007 |

OTHER PUBLICATIONS

Marro, C et al., "Analysis of Noise Reduction and Dereverberation Techniques Based on Microphone Arrays with Postfiltering", IEEE Transactions on Speech and Audio Processing, IEE Service Center, New York, NY. US. vol. 6, No. 3, May 1, 1998, pp. 240-259, XP-000785354.

Extended European Search Report dated Sep. 24, 2012 for corresponding European Application No. 11193313.1.

Japanese Office Action mailed Apr. 8, 2014 for corresponding Japanese Patent Application No. 2010-282436 dated, with Partial English Translation, 7pages.

Office Action issued Feb. 3, 2015, in Japanese Patent Application No. 2010-282436 (Partial English translation provided).

* cited by examiner

SOUND PROCESSING APPARATUS AND RECORDING MEDIUM STORING A SOUND PROCESSING PROGRAM

CROSS-REFERENCE TO RELATED APPLICATIONS

This application is based upon and claims the benefit of priority of the prior Japanese Patent Application No. 2010-282436, filed on Dec. 17, 2010, the entire contents of which are incorporated herein by reference.

FIELD

The embodiments disclosed herein relate to a sound processing apparatus and a recording medium for storing a sound processing program.

BACKGROUND

In recent years, a sound processing apparatus such as a microphone array has been manufactured for the purpose of installing the sound processing apparatus in a hands-free phone or the like. The sound processing apparatus performs a process of suppressing stationary noise included in an input sound. The stationary noise is a sound that is input to the sound processing apparatus from a plurality of directions. When a vehicle is taken as an example, the stationary noise corresponds to a sound (road noise) of a tire of the vehicle during traveling of the vehicle, a sound of air blown by an air conditioner installed in the vehicle, and the like. For example, as one technique for suppressing a sound, there is a synchronous subtraction method that enables a sound input from a specific direction to be suppressed. Although the sound that is input from the specific direction can be suppressed by the synchronous subtraction method, it is difficult to sufficiently suppress sounds (such as stationary noise) input from a plurality of directions in the synchronous subtraction method.

The sound processing apparatus uses a suppression processing method using a spectral subtraction scheme for processing an input signal on a frequency axis. When the suppression processing method is used, the sound processing apparatus uses a window function to perform a windowing process on an input signal subjected to a synchronous subtraction process and performs high-speed Fourier transform on the input signal subjected to the synchronous subtraction process so as to divide the input signal into a phase spectrum and a power spectrum. Then, the sound processing apparatus subtracts, from the power spectrum, a power spectrum that corresponds to stationary noise. After that, the sound processing apparatus performs inverse Fourier transform on the phase spectrum and the power spectrum and restores the signal so that the restored signal has the suppressed stationary noise. Since the sound processing apparatus uses the suppression processing method, the sound processing apparatus can obtain an excellent result of suppression of a component that corresponds to the stationary noise included in the input signal. For example, the suppression processing method that is performed using the spectral subtraction scheme is disclosed in International Publication Pamphlet No. WO2007/018293, Japanese Laid-open Patent Publication No. 2003-271191, and "Suppression of Acoustic Noise in Speech Using Spectral Subtraction" by Steve F. Boll, IEEE TRANSACTIONS ON ACOUSTICS, SPEECH, AND SIGNAL PROCESSING, VOL. ASSP-27, NO. 2, APRIL 1979.

SUMMARY

According to an aspect of the invention, a sound processing apparatus includes: a first calculator that calculates first power based on a first signal received by a first microphone that is among the first microphone and a second microphone; a second calculator that calculates second power based on a second signal received by the second microphone; a gain calculator that calculates a gain on the basis of the ratio of the first power to the second power; and a multiplier that processes the second signal using the gain calculated by the gain calculator.

The object and advantages of the invention will be realized and attained by at least the features, elements, and combinations particularly pointed out in the claims.

It is to be understood that both the foregoing general description and the following detailed description are exemplary and explanatory and are not restrictive of the invention, as claimed.

DESCRIPTION OF EMBODIMENTS

When the aforementioned suppression processing method is used, it is necessary to wait for a process of converting the input signal into a signal on a frequency axis until a certain number of samples of the input signal are accumulated. In the conventional technique, after the process of suppressing the input signal on a frequency axis is performed, the signal is converted into a signal on a time axis for a time period that is equal to or nearly equal to the time period in which the suppression process is performed. When stationary noise is suppressed using the aforementioned suppression processing method, the process is generally delayed for several tens of milliseconds in the sound processing apparatus, depending on the quality of noise suppression to be required. Thus, the quality of a signal that is provided from the sound processing apparatus to a device (such as a hands-free phone) having the sound processing apparatus installed therein is not necessarily high from the perspective of the quality of a call. For example, it is considered that a process of providing the signal from the sound processing apparatus to the hands-free phone is delayed for a time period that corresponds to a process delay occurring in the process of suppressing stationary noise. In such a case, the signal to be reproduced in the hands-free phone is delayed. Thus, the quality of a call in an actual time is reduced.

It is, therefore, an object of the embodiments disclosed herein to provide a sound processing apparatus and a sound processing program, which can reduce a time period for a process to be performed on an input signal including stationary noise, compared to the technique for processing an input signal on a frequency axis.

Embodiments of the sound processing apparatus disclosed herein and the sound processing program disclosed herein are described below in detail with reference to the accompanying drawings. The embodiments of the sound processing apparatus disclosed herein and the sound processing program disclosed herein do not limit the technique disclosed herein, and can be combined when necessary so that there is no discrepancy in contents of processes.

First Embodiment

Figure 1A:
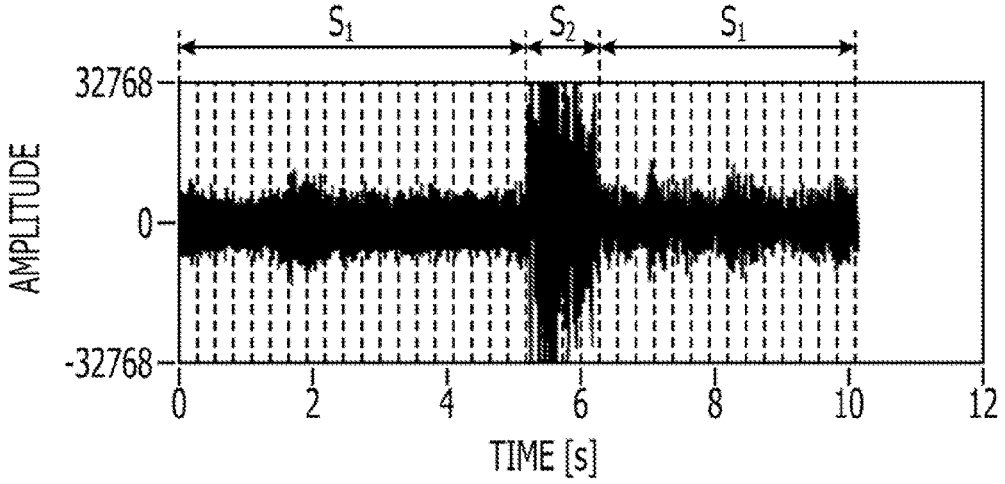
FIGS. 1A and 1B are diagrams for explaining a sound processing apparatus according to a first embodiment.
Figure 1B:
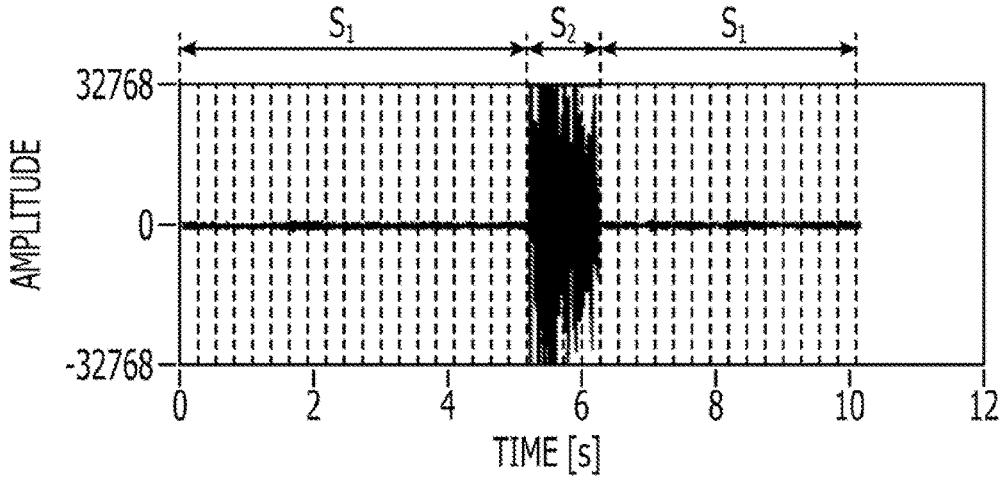

A sound processing apparatus according to a first embodiment is described with reference to FIGS. 1A and 1B. FIGS. 1A and 1B are diagrams for explaining the sound processing apparatus according to the first embodiment. FIGS. 1A and 1B illustrate examples of a waveform of a digital signal that is represented along a time axis and includes stationary noise and a sound (such as a user's sound) to be saved. The digital signal is hereinafter referred to as a signal. FIG. 1A illustrates an example of a waveform of a signal that is received by the sound processing apparatus, while FIG. 1B illustrates an example of a waveform of a signal that is output from the sound processing apparatus. When a single sampled signal that is obtained by sampling the signal at an 8 kHz sampling rate (or by sampling the signal every 1/8000 seconds) is expressed using 16 bits, the value of the single sampled signal is in a range of −32767 to 32768. In FIGS. 1A and 1B, the ordinate indicates the amplitude of the signal, and the abscissa indicates time.

Symbols S1 illustrated in FIGS. 1A and 1B each indicate a part that corresponds to the stationary noise in the signal. In addition, symbols S2 illustrated in FIGS. 1A and 1B each indicate a part that includes the stationary noise and the sound to be saved in the signal.

As indicated by dotted lines of FIGS. 1A and 1B, the sound processing apparatus according to the first embodiment acquires a single sampled signal at each of equal intervals (for example, 8 kHz sampling), calculates a gain for each of the acquired signals, and processes the signals on the basis of the calculated gains. In other words, according to the sound processing apparatus according to the first embodiment, the amount of a reduction in the amplitude of the acquired signal varies depending on the acquired signal. As a result, as is apparent from a comparison of FIG. 1A with FIG. 1B, the parts that are indicated by S1 and have significantly reduced amplitudes are output, and the parts that are included in the waveform and indicated by S2 and have almost unchanged amplitudes are output.

In this manner, the sound processing apparatus according to the first embodiment calculates a gain for each of the acquired signals and reduces the amplitudes of the signals on the basis of the calculated gains. Thus, the sound processing apparatus according to the first embodiment can reduce a time period for the process to be performed on an input signal including stationary noise, compared to the technique for processing an input signal on a frequency axis.

In addition, even when a sound to be heard includes noise, people have aural characteristics in which the presence of the sound to be heard does not make people become conscious of the presence of the noise. When a signal that is received by the sound processing apparatus according to the first embodiment barely includes a signal corresponding to a sound (such as a user's sound) to be saved, or when a most part of the signal is a signal corresponding to stationary noise, the sound processing apparatus according to the first embodiment reduces the amplitude of the signal as much as possible. Specifically, the sound processing apparatus according to the first embodiment reduces the amplitude of the signal as much as possible for the aural characteristics of people when the noise is unpleasant.

It can be also said that as the proportion of a signal corresponding to a sound to be saved to a signal received by the sound processing apparatus according to the first embodiment is higher, the sound processing apparatus according to the first embodiment reduces the amount of a reduction in the amplitude of the signal corresponding to the sound to be saved. For example, when a signal that corresponds to a sound of a call is included in a signal to be provided to a hands-free phone, a user of the hands-free phone is not conscious of the presence of noise due to the aforementioned aural characteristics. As the proportion of the signal corresponding to the sound to be saved to the signal received by the sound processing apparatus according to the first embodiment is higher, the sound processing apparatus according to the first embodiment reduces the amount of the reduction in the amplitude of the signal corresponding to the sound to be saved. Thus, the sound processing apparatus according to the first embodiment suppresses the sound of the call as little as possible.

Configuration of Sound Processing Apparatus (First Embodiment)

Figure 2:
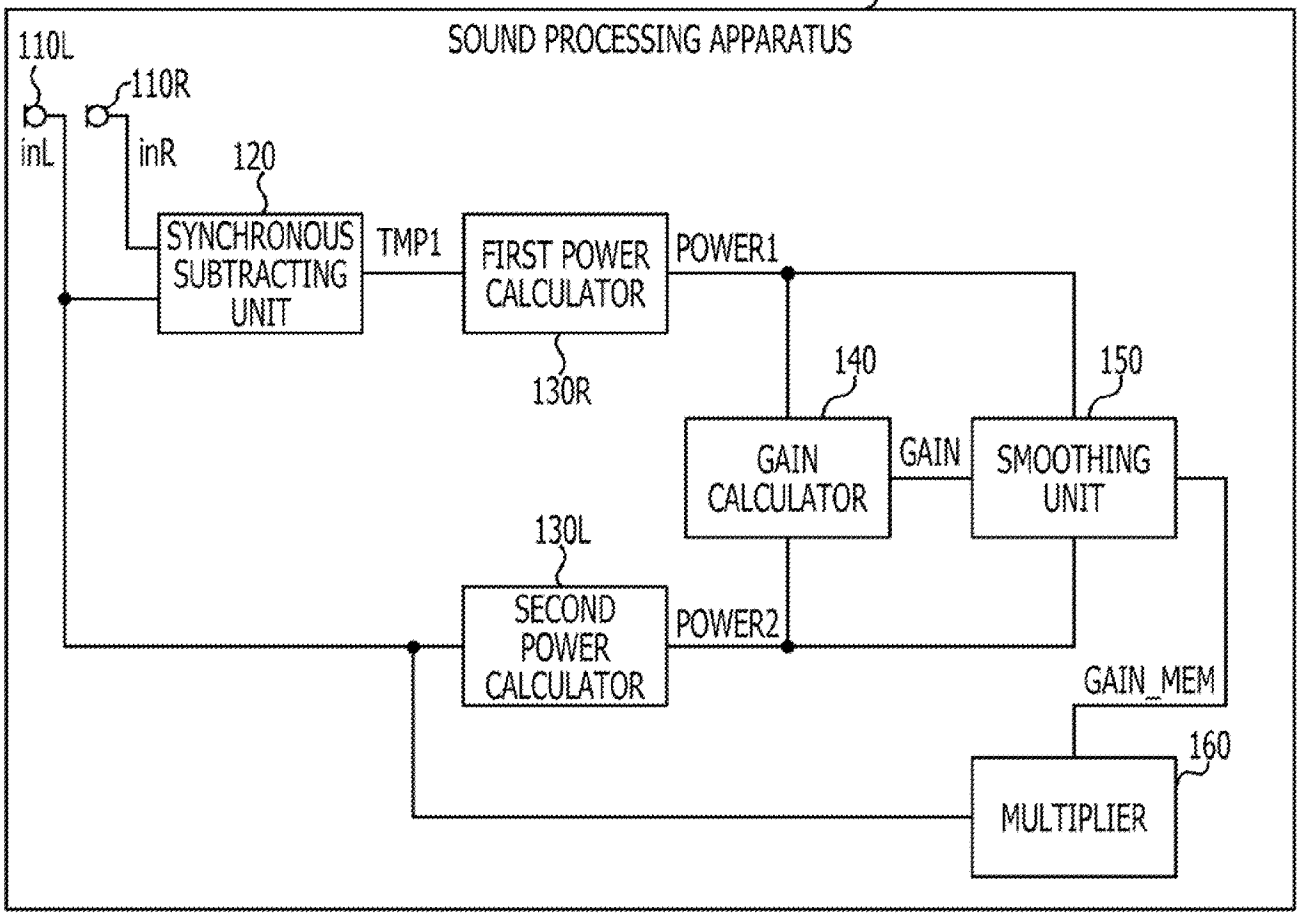
FIG. 2 is a functional block diagram illustrating a functional configuration of the sound processing apparatus according to the first embodiment.

FIG. 2 is a functional block diagram illustrating a functional configuration of the sound processing apparatus according to the first embodiment. As illustrated in FIG. 2, the sound processing apparatus 100 according to the first embodiment includes a sound input unit 110R, a sound input unit 110L, a synchronous subtracting unit 120, a first power calculator 130R, a second power calculator 130L, a gain calculator 140, a smoothing unit 150 and a multiplier 160.

The sound input unit 110R and the sound input unit 110L are omnidirectional microphones that have substantially equal sensitivities in all directions in a range of 360 degrees, for example. The sound input unit 110R is arranged on the side of a region at which noise (such as stationary noise) that is to be suppressed and is included in a signal to be processed by the sound processing apparatus 100 arrives. The sound input unit 110L is arranged on the side of a region at which a sound (such as a user's sound) that is to be saved and is included in the signal to be processed by the sound processing apparatus 100 arrives.

For example, when the sound processing apparatus according to the first embodiment is installed in a hands-free phone to be used in a vehicle or is installed in a navigation device to be used in a vehicle, the sound input unit 110R is a microphone arranged at a predetermined position on the side of a front passenger seat, and the sound input unit 110L is a microphone arranged at a predetermined position on the side of a driver's seat. A signal that arrives from the side of the sound input unit 110R and is input to the sound input unit 110R is a signal corresponding to noise to be suppressed. The noise to be suppressed is a sound assumed to be noise.

The synchronous subtracting unit 120 synchronously subtracts a signal input to the sound input unit 110L from a signal input to the sound input unit 110R in order to obtain a signal formed by highlighting the signal that has arrived from the side of the sound input unit 110R. For example, the synchronous subtracting unit 120 stands by until it is time to convert the signals input to the sound input units 110R and 110L into digital audio data in accordance with a predetermined sampling frequency. When it is time to convert the signals, the synchronous subtracting unit 120 acquires audio data (inR) of the signal input to the sound input unit 110R and audio data (inL) of the signal input to the sound input unit 110L.

Figure 3:
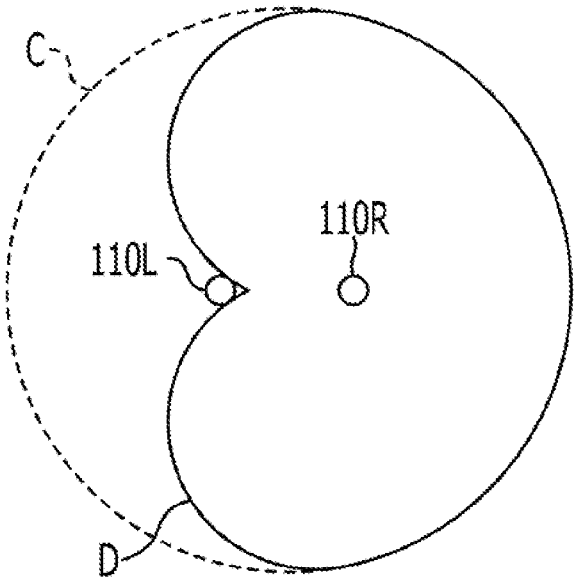
FIG. 3 is a diagram for explaining a synchronous subtracting unit according to the first embodiment.

When the synchronous subtracting unit 120 needs to synchronously subtract the signal input to the sound input unit 110L from the signal input to the sound input unit 110R, the signals are synchronized with each other. When signals that correspond to the same sound are input to the sound input units 110R and 110L, the synchronous subtracting unit 120 calculates the difference between the numbers of samples on the basis of an acoustic velocity, an interval between the sound input unit 110R and the sound input unit 110L, and a sampling frequency. It is assumed that the synchronous subtracting unit 120 performs the calculation and thereby determines that a signal that corresponds to substantially the same sound as a sound corresponding to the signal input to the sound input unit 110L is input to the sound input unit 110R after one sampling interval. In this assumption, the synchronous subtracting unit 120 acquires a signal inR(t) of a sample number "t" and a signal inL(t−1) of a sample number "t−1" that precedes the sample number "t" by one sampling interval. Then, the synchronous subtracting unit 120 subtracts the signal inL(t−1) of the sample number "t−1" from the signal inR(t) of the sample number "t". An image of the result of the synchronous subtraction performed by the synchronous subtracting unit 120 is described below with reference to FIG. 3. FIG. 3 is a diagram for explaining the synchronous subtracting unit according to the first embodiment.

A symbol "C" illustrated in FIG. 3 indicates an example of a polar pattern of the sound input unit 110R before the synchronous subtracting unit 120 performs the synchronous subtraction. A symbol "D" illustrated in FIG. 3 indicates an example of a polar pattern of the sound input unit 110R after the synchronous subtracting unit 120 performs the synchronous subtraction. It is assumed that a sound is generated on an imaginary straight line connecting the sound input units 110R and 110L (illustrated in FIG. 2) to each other and in a region located on the left side of the sound input unit 110L. In this assumption, when the synchronous subtracting unit 120 performs the synchronous subtraction, only a signal that corresponds to the sound generated in the region located on the left side of the sound input unit 110L is removed from a signal input to the sound input unit 110R. In other words, as a result of the synchronous subtraction performed by the synchronous subtracting unit 120, the sound input unit 110R serves as substantially the same function as a directional microphone having such a polar pattern as indicated by "D" illustrated in FIG. 3. Thus, even when an omnidirectional microphone such as the sound input unit 110R is arranged on the side of a region at which a sound (such as stationary noise) to be suppressed arrives, the synchronous subtracting unit 120 performs the synchronous subtraction and can thereby highlight a signal corresponding to the sound (such as stationary noise) to be suppressed.

Returning to FIG. 2, the first power calculator 130R calculates power of the result (tmp1) of the synchronous subtraction performed by the synchronous subtracting unit 120. For example, the first power calculator 130R calculates power (Power1) by squaring the result (tmp1) of the synchronous subtraction. The first power calculator 130R may use a value obtained by normalizing each of power levels calculated from sample values included in the same sample number. In addition, the first power calculator 130R may use a value obtained by summing the power levels calculated from the sample values included in the same sample number.

The second power calculator 130L calculates power of the signal (inL) input to the sound input unit 110L. For example, the second power calculator 130L calculates power (Power2) by squaring the amplitude of the signal (inL). The second power calculator 130L may use a value obtained by normalizing each of the power levels calculated from the sample values included in the same sample number. In addition, the second power calculator 130L may use a value obtained by summing the power levels calculated from the sample values included in the same sample number.

The gain calculator 140 calculates a gain (gain) using the power (Power1) of the result (tmp1) of the synchronous subtraction and the power (Power2) of the signal (inL). The calculated gain (gain) is used to reduce the amplitude of the signal (inL). For example, the gain calculator 140 subtracts the power (Power1) (of the signal (tmp1)) calculated by the first power calculator 130R from the power (Power2) (of the signal (inL)) calculated by the second power calculator 130L. Then, the gain calculator 140 calculates the gain (gain) by calculating the square root of a value obtained by dividing the result (Power21) of the subtraction by the power (Power2) of the signal (inL). The gain (gain) calculated by the gain calculator 140 is expressed by the following Equation (1).

$$gain=(Power21\div Power2)^{0.5} \quad (1)$$

The smoothing unit 150 smoothes the gain (gain) calculated by the gain calculator 140. The gain (gain_mem) smoothed by the smoothing unit 150 is expressed by the following Equation (2). In the following Equation (2), "α" is a coefficient that is set by the smoothing unit 150 so that $0\leq\alpha<1$. In the following Equation (2), "gain_mem'" is a gain that is smoothed by the smoothing unit 150 in a process performed on a processed signal of a previous sample number.

$$gain_mem=\alpha\times gain_mem'+(1-\alpha)\times gain \quad (2)$$

The smoothing unit 150 sets the value of "α" used in the aforementioned Equation (2) on the basis of the gain (gain) calculated by the gain calculator 140 and the gain (gain_mem') smoothed in the process performed on the processed signal of the previous sample number. For example, when the gain (gain) is approximately four times larger than the gain (gain_mem'), the smoothing unit 150 sets, as the value of "α", a value that is as small as possible. Specifically, when the gain (gain) is approximately four times larger than the gain (gain_mem'), there is a high possibility that the input sound may be a highly nonstationary sound that is different from stationary noise, or there is a high possibility that the sound may be a sound (such as a user's sound) to be saved. Thus, the smoothing unit 150 sets, as the value of "α", a value that is as small as possible, in order to improve a property of tracking the current sound.

The multiplier 160 uses the gain (gain_mem) smoothed by the smoothing unit 150 and processes the signal (inL) input to the sound input unit 110L. For example, the multiplier 160 suppresses and processes the signal (inL) by multiplying the signal (inL) input to the sound input unit 110L by the gain (gain_mem) smoothed by the smoothing unit 150. Then, the multiplier 160 outputs the suppression result (out).

The sound processing apparatus 100 illustrated in FIG. 2 includes a storage unit (not illustrated) such as a semiconductor memory element that is a random access memory (RAM), a flash memory or the like. In addition, the sound processing apparatus 100 illustrated in FIG. 2 has a controller (not illustrated) that controls the synchronous subtracting unit 120, the first power calculator 130R, the second power calculator 130L, the gain calculator 140, the smoothing unit 150, the multiplier 160 and the like. The controller corresponds to an electronic circuit or an integrated circuit. The electronic circuit or the integrated circuit control uses the storage unit and controls the processes that are performed by the synchronous subtracting unit 120, the first power calculator 130R, the second power calculator 130L, the gain calculator 140, the smoothing unit 150 and the multiplier 160. Examples of the electronic circuit are a central processing unit (CPU) and a micro processing unit (MPU). Examples of the integrated circuit are an application specific integrated circuit (ASIC) and a field programmable gate array (FPGA).

Process to be Performed by Sound Processing Apparatus (First Embodiment)

Figure 4:
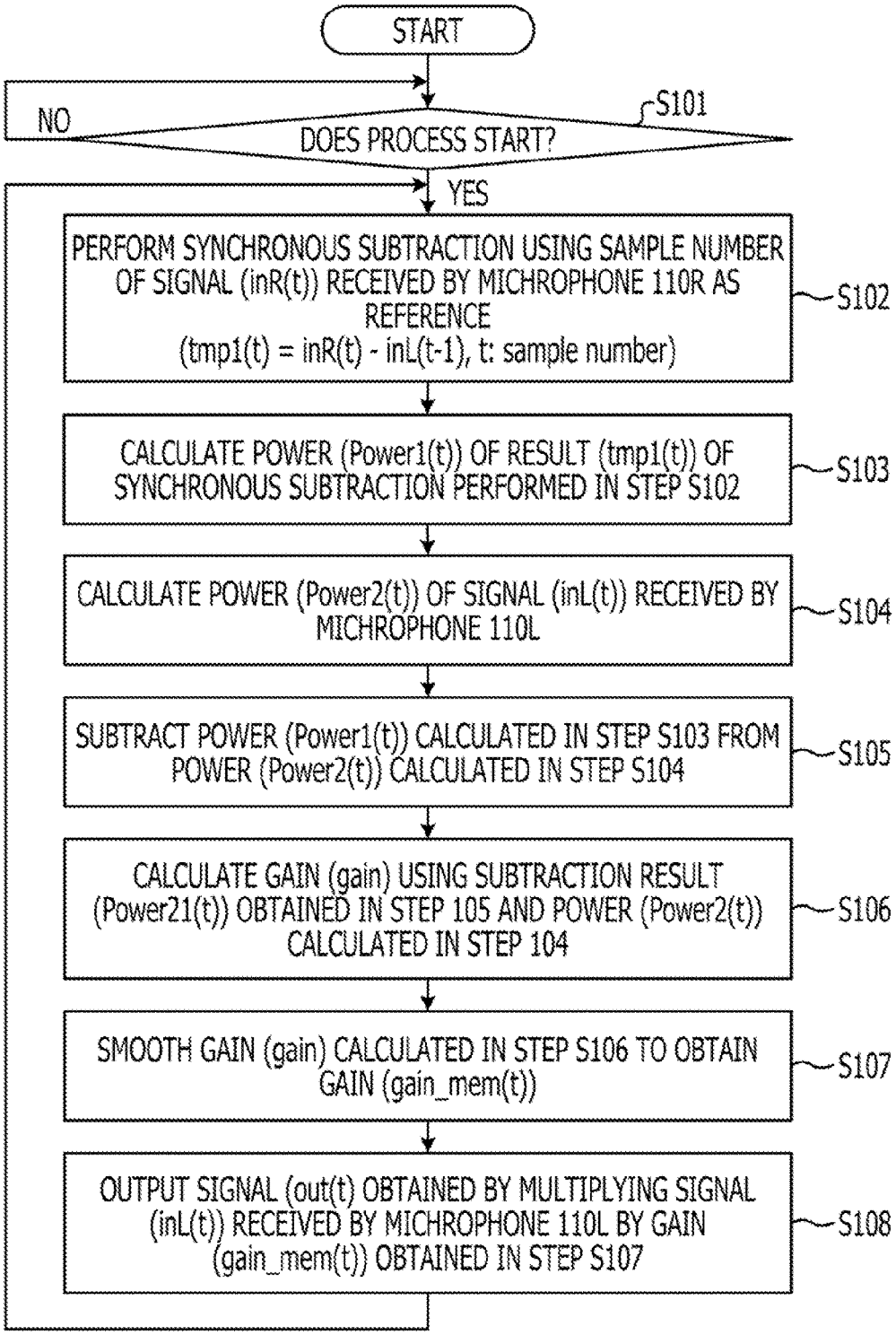
FIG. 4 is a diagram illustrating the flow of a process that is performed by the sound processing apparatus according to the first embodiment.

Next, the flow of a process that is performed by the sound processing apparatus 100 according to the first embodiment is described with reference to FIG. 4. FIG. 4 is a diagram illustrating the flow of the process that is performed by the sound processing apparatus according to the first embodiment. In the following description using FIG. 4, "microphones" correspond to the aforementioned sound input units.

As illustrated in FIG. 4, the sound processing apparatus 100 determines whether or not the process starts (in step S101). For example, the sound processing apparatus 100 determines whether or not the process starts on the basis of whether or not the sound processing apparatus 100 has received an instruction to start the process. When the sound processing apparatus 100 determines that the process does not start (No in step S101), the sound processing apparatus 100 repeatedly determines whether or not the process starts.

On the other hand, when the sound processing apparatus 100 determines that the process starts (Yes in step S101), the synchronous subtracting unit 120 performs the synchronous subtraction using the sample number of the signal (inR(t)) received by the microphone 110R as a reference (in step S102). For example, the process of step S102 can be performed using the following Equation (3).

$$tmp1(t)=\mathrm{in}R(t)-\mathrm{in}L(t-1) \tag{3}$$

In Equation (3), inR(t) is the signal (amplitude) (of the sample number "t") received by the microphone 110R, inL(t−1) is the signal (amplitude) (of the sample number "t−1") received by the microphone 110L, and tmp1(t) is a signal obtained by performing the synchronous subtraction.

Next, the first power calculator 130R calculates power (Power1(t)) of the result of the synchronous subtraction performed in step S102 (in step S103). For example, the process of step S103 can be performed using the following Equation (4).

$$\mathrm{Power1}(t)=\Sigma tmp1(t)^2 \tag{4}$$

Next, the second power calculator 130L calculates power (Power2(t)) of the signal received by the microphone 110L (in step S104). For example, the process of step S104 can be performed using the following Equation (5).

$$\mathrm{Power2}(t)=\Sigma \mathrm{in}L(t)^2 \tag{5}$$

In Equation (5), inL(t) is the signal (amplitude) (of the sample number "t") received by the microphone 110L.

Next, the gain calculator 140 subtracts the power (Power1(t)) calculated in step S103 from the power (Power2(t)) calculated in step S104 (in step S105). For example, the process of step S105 can be performed using the following Equation (6).

$$\mathrm{Power21}(t)=\mathrm{Power2}(t)-\mathrm{Power1}(t) \tag{6}$$

In Equation (6), Power21(t) is the result of the subtraction performed in the process of step S105.

Subsequently, the gain calculator 140 calculates a gain (gain(t)) using the subtraction result (Power21(t)) obtained in step S105 and the power (Power2(t)) calculated in step S104 (in step S106). The gain (gain(t)) is a gain that is used to suppress noise included in the signal received by the microphone 110L. For example, the process of step S106 can be performed using the following Equation (7).

$$\mathrm{gain}(t)=(\mathrm{Power21}(t)\div\mathrm{Power2}(t))^{0.5} \tag{7}$$

Next, the smoothing unit 150 smoothes the gain (gain(t)) calculated in step S106 (in step S107). For example, the process of step S107 can be performed using the following Equation (8).

$$\mathrm{gain_mem}(t)=\alpha\times\mathrm{gain_mem}(t-1)+(1-\alpha)\times\mathrm{gain}(t) \tag{8}$$

In Equation (8), gain_mem(t) is a gain obtained by smoothing the gain(t), and gain_mem(t−1) is a process result of step S107 performed on the previous sample number.

Subsequently, the multiplier 160 outputs a signal (out(t)) processed by multiplying the signal (inL(t)) received by the microphone 110L by the gain (gain_mem(t)) calculated in step S107 (in step S108). For example, the process of step S108 can be performed using the following Equation (9).

$$\mathrm{out}(t)=\mathrm{gain_mem}(t)\times\mathrm{in}L(t) \tag{9}$$

Then, when the process of step S108 is completed, the sound processing apparatus 100 causes the process to return to the aforementioned step S102. In addition, the sound processing apparatus 100 repeatedly performs the processes of steps S102 to S108 illustrated in FIG. 4 until power supply is stopped or until the sound processing apparatus 100 receives an instruction to terminate the process. The order of the processes illustrated in FIG. 4 can be changed when necessary so that there is no discrepancy in the contents of the processes.

Effects of First Embodiment

As described above, the sound processing apparatus 100 suppresses stationary noise by performing the simple process of controlling the amount of a reduction in the amplitude of a signal without suppression of a sound (such as a user's sound) to be saved, as expressed by the aforementioned Equations (1) and (7). The sound processing apparatus 100 can perform the process on an input signal including stationary noise on a time axis. Thus, it is possible to reduce a delay of the process, compared to the technique for processing a signal on a frequency axis.

In addition, when most of a signal received by the sound processing apparatus 100 corresponds to stationary noise, the sound processing apparatus 100 maximally suppresses the stationary noise by reducing the amplitude of the signal as much as possible for the aural characteristics of people when the noise is unpleasant. According to the first embodiment, the process can be performed in consideration of the aural characteristics of people. As a result, it is possible to improve the quality of a signal that is provided from the sound processing apparatus 100 to a device.

In addition, as the proportion of a signal corresponding to a sound (such as a user's sound) to be saved to a signal received by the sound processing apparatus 100 is higher, the sound processing apparatus 100 reduces the amount of a reduction in the amplitude of a signal of an interested sample number. Thus, the sound processing apparatus 100 reduces the amplitude of the signal so as to prevent a call sound volume from becoming unnecessarily low. According to the first embodiment, the process can be performed in consideration of the aural characteristics of people. As a result, it is possible to improve the quality of the signal that is provided from the sound processing apparatus 100 to the device.

In addition, the sound processing apparatus 100 uses a gain used for a previously sampled sound and smoothes a gain for a sound that is currently sampled. Thus, the sound processing apparatus 100 can substantially prevent the quality of a signal from being degraded due to the difference between the gain used for the previously sampled signal and the gain calculated in the process of step S106 illustrated in FIG. 4. In conjunction with the gains, it is possible to substantially improve a property of tracking a highly non-stationary user's sound in the first embodiment. As a result, it is possible to substantially improve the quality of the signal that is provided from the sound processing apparatus 100 to the device.

The sound processing apparatus 100 may not include the smoothing unit 150. For example, when a reduction in a delay of the process is emphasized, the smoothing unit 150 may be removed from the configuration of the sound processing apparatus 100.

Second Embodiment

The first embodiment describes that the process (process of highlighting a signal input to the microphone 110R) of highlighting a signal corresponding to noise such as stationary noise is performed by performing the synchronous subtraction. The first embodiment, however, is not limited to this. For example, a process (process of highlighting a signal that is input to the sound input unit and corresponds to a sound to be saved) of highlighting a signal corresponding to a sound (such as a user's sound) to be saved may be performed by performing the synchronous subtraction.

Configuration of Sound Processing Apparatus (Second Embodiment)

Figure 5:
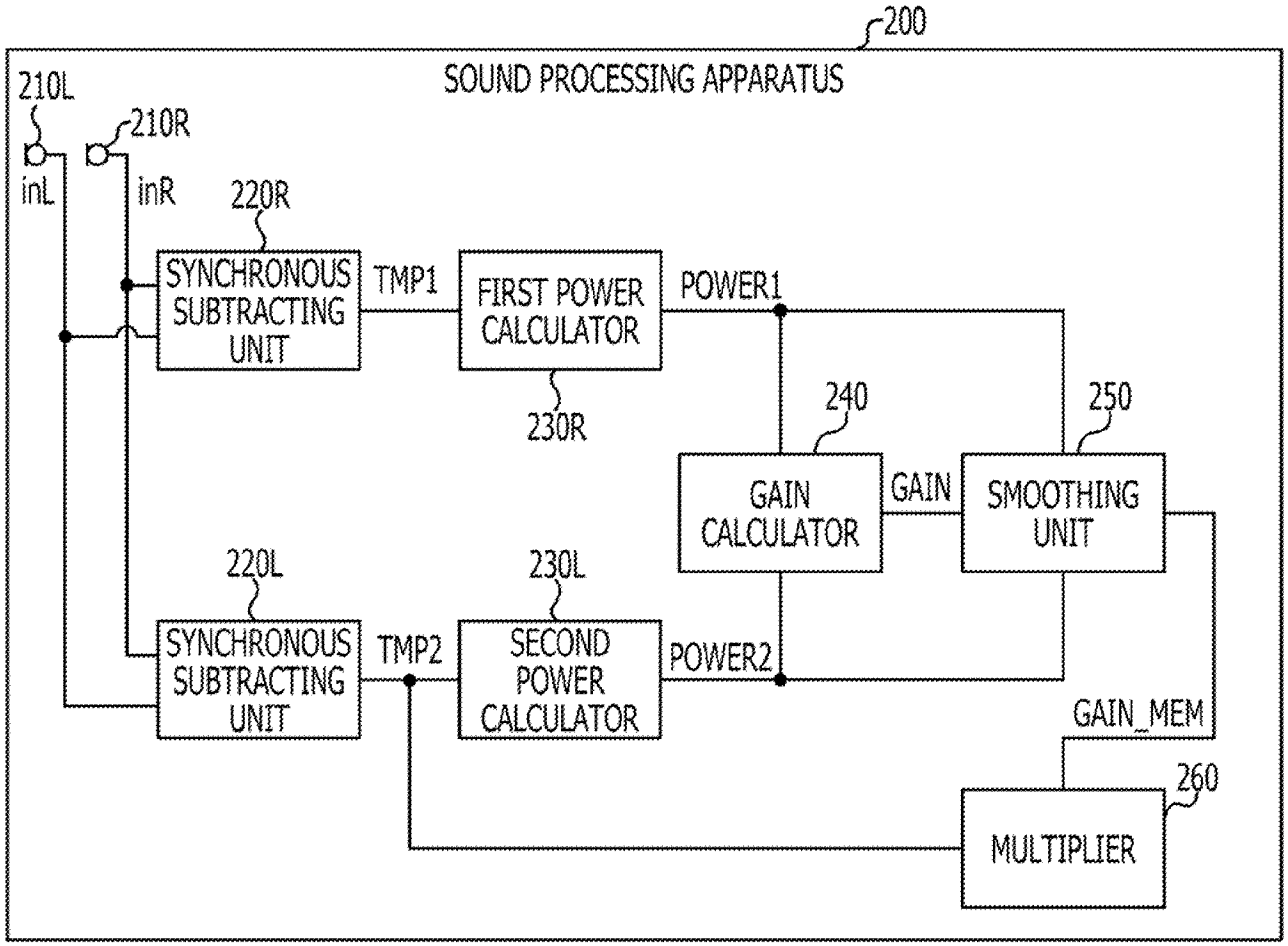
FIG. 5 is a functional block diagram illustrating a functional configuration of a sound processing apparatus according to a second embodiment.

FIG. 5 is a functional block diagram illustrating a configuration of a sound processing apparatus according to a second embodiment. As illustrated in FIG. 5, the sound processing apparatus 200 according to the second embodiment includes substantially the same configuration as the sound processing apparatus 100 according to the first embodiment. Specifically, a sound input unit 210R corresponds to the sound input unit 110R. A sound input unit 210L corresponds to the sound input unit 110L. A synchronous subtracting unit 220R corresponds to the synchronous subtracting unit 120. A first power calculator 230R corresponds to the first power calculator 130R. A second power calculator 230L corresponds to the second power calculator 130L. A gain calculator 240 corresponds to the gain calculator 140. A smoothing unit 250 corresponds to the smoothing unit 150. A multiplier 260 corresponds to the multiplier 160. The sound processing apparatus 200 according to the second embodiment also includes a synchronous subtracting unit 220L. As a result, the sound processing apparatus 200 according to the second embodiment includes the following features that are different from the sound processing apparatus 100 according to the first embodiment.

The synchronous subtracting unit 220R synchronously subtracts a signal input to the sound input unit 210L from a signal input to the sound input unit 210R for the purpose of obtaining a signal formed by highlighting a signal that has arrived from the side of the sound input unit 210R, in substantially the same manner as the aforementioned first embodiment. The signal input to the sound input unit 210R is a signal of a sound assumed to be noise.

The first power calculator 230R calculates power of the result (tmp1) of the synchronous subtraction performed by the synchronous subtracting unit 220R in substantially the same manner as the aforementioned first embodiment.

The synchronous subtracting unit 220L synchronously subtracts the signal input to the sound input unit 210R from the signal input to the sound input unit 210L for the purpose of obtaining a signal formed by highlighting a signal that has arrived from the side of the sound input unit 210L. The synchronous subtracting unit 220L performs the synchronous subtraction in substantially the same manner as the synchronous subtracting unit 220R. For example, the synchronous subtracting unit 220L acquires a signal inL(t) of a sample number "t" and a signal inR(t−1) of a sample number "t−1" that precedes the sample number "t" by one sampling interval. Then, the synchronous subtracting unit 220L subtracts the signal inR(t−1) from the signal inL(t).

The second power calculator 230L calculates power of the result (tmp2) of the synchronous subtraction performed by the synchronous subtracting unit 220L in substantially the same manner as the first power calculator 230R. For example, the second power calculator 230L calculates power (Power2) by squaring the result (tmp2) of the synchronous subtraction.

The gain calculator 240 calculates a gain using the power (Power1) of the result (tmp1) of the synchronous subtraction and the power (Power2) of the result (tmp2) of the synchronous subtraction, while the gain is used to suppress the result (tmp2) of the synchronous subtraction. For example, the gain calculator 240 subtracts the power (Power1) (calculated by the first power calculator 230R) of the result (tmp1) of the synchronous subtraction from the power (Power2) (calculated by the second power calculator 230L) of the result (tmp2) of the synchronous subtraction. Then, the gain calculator 240 calculates the gain (gain) by calculating the square root of a value obtained by dividing the result (Power21) of the subtraction by the power (Power2) of the result (tmp2) of the synchronous subtraction. The gain (gain) calculated by the gain calculator 240 is expressed by the aforementioned Equation (1), for example.

The smoothing unit 250 smoothes the gain (gain) calculated by the gain calculator 240 in substantially the same manner as the smoothing unit 150 according to the first embodiment.

The multiplier 260 uses the gain (gain_mem) smoothed by the smoothing unit 250 and processes the result (tmp2) of the synchronous subtraction performed by the synchronous subtracting unit 220L. Specifically, the multiplier 260 suppresses and processes the result (tmp2) of the synchronous subtraction by multiplying the result (tmp2) of the synchronous subtraction performed by the synchronous subtracting unit 220L by the gain (gain_mem) smoothed by the smoothing unit 250. Thus, noise that is included in the result (tmp2) of the synchronous subtraction is suppressed. Then, the multiplier 260 outputs the suppression result (out).

Process to be Performed by Sound Processing Apparatus (Second Embodiment)

Figure 6:
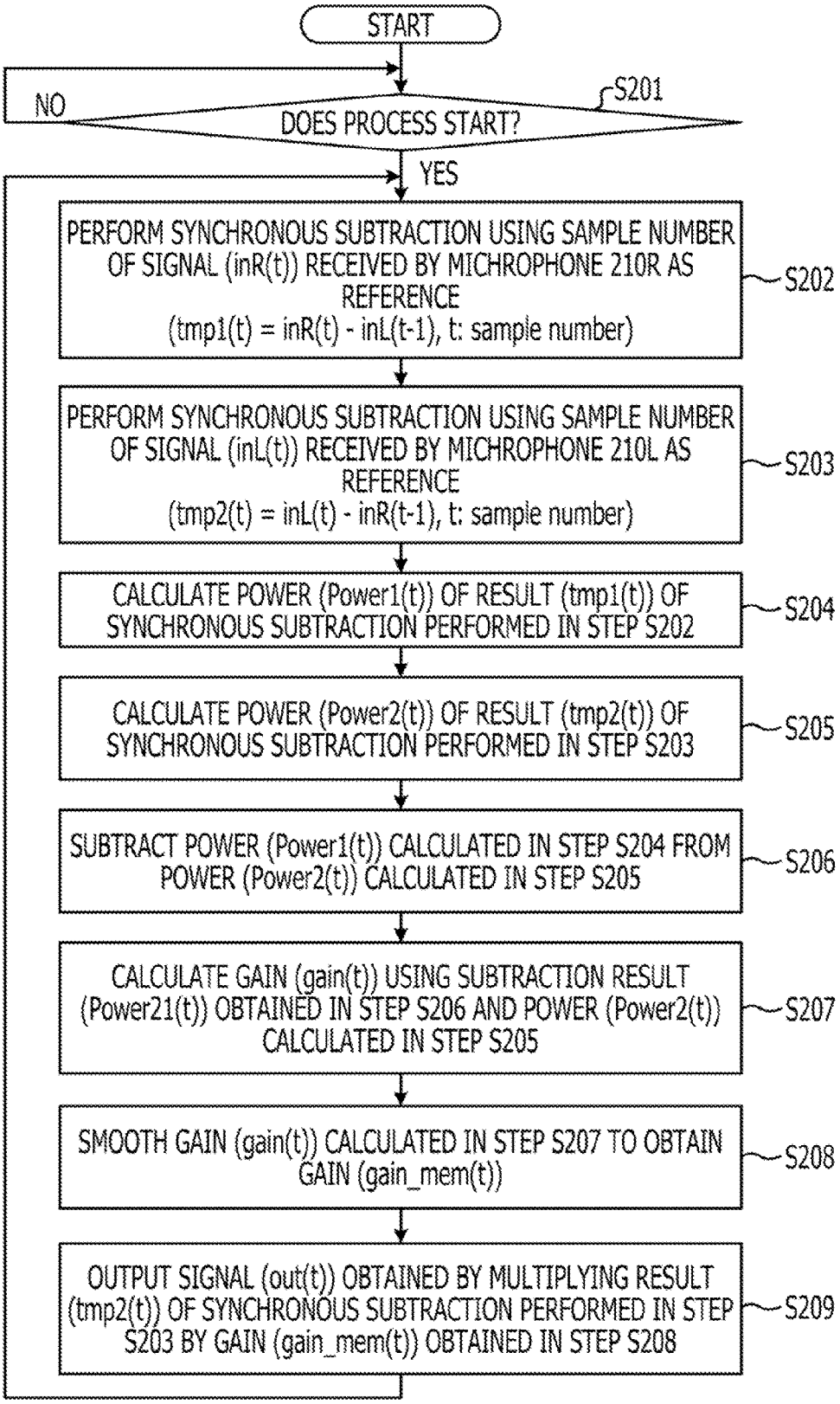
FIG. 6 is a diagram illustrating the flow of a process that is performed by the sound processing apparatus according to the second embodiment.

Next, the flow of a process that is performed by the sound processing apparatus 200 according to the second embodiment is described with reference to FIG. 6. FIG. 6 is a diagram illustrating the flow of the process that is performed by the sound processing apparatus according to the second embodiment. In the following description using FIG. 6, "microphones" correspond to the aforementioned sound input units.

As illustrated in FIG. 6, a controller of the sound processing apparatus 200 or the like determines whether or not the process starts (in step S201). For example, the controller of the sound processing apparatus 200 or the like determines whether or not the process starts on the basis of whether or not the sound processing apparatus 200 has received an instruction to start the process. When the controller of the sound processing apparatus 200 or the like determines that the process does not start (No in step S201), the controller of the sound processing apparatus 200 or the like repeatedly determines whether or not the process starts.

On the other hand, when the controller of the sound processing apparatus 200 or the like determines that the process starts (Yes in step S201), the synchronous subtracting unit 220R performs the synchronous subtraction using the sample number of the signal (inR(t)) received by the microphone 210R as a reference (in step S202). For example, the process of step S202 can be performed using the aforementioned Equation (3).

Next, the synchronous subtraction 220L performs the synchronous subtraction using the signal (inL(t)) received by the microphone 210L as a reference (in step S203). For example, the process of step S203 can be performed using the following Equation (10).

$$tmp2(t)=\mathrm{in}L(t)-\mathrm{in}R(t-1) \tag{10}$$

In Equation (10), inL(t) is the signal (amplitude) (of the sample number (t)) received by the microphone 210L, inR(t−1) is the signal (amplitude) (of the sample number (t−1)) received by the microphone 210R, and tmp2(t) is a signal obtained by performing the synchronous subtraction.

Subsequently, the first power calculator 230R calculates power (Power1(t)) of the result of the synchronous subtraction performed in step S202 (in step S204). For example, the process of step S204 can be performed using the aforementioned Equation (4).

Next, the second power calculator 230L calculates power (Power2(t)) of the result of the synchronous subtraction performed in step S203 (in step S205). For example, the process of step S205 can be performed using the following Equation (11).

$$\mathrm{Power2}(t)=\Sigma tmp2(t)^2 \tag{11}$$

Then, the gain calculator 240 subtracts the power (Power1(t)) calculated in step S204 from the power (Power2(t)) calculated in step S205 (in step S206). For example, the process of step S206 can be performed using the aforementioned Equation (6).

Next, the gain calculator 240 calculates a gain (gain(t)) using the subtraction result (Power21(t)) obtained in step S206 and the power (Power2(t)) calculated in step S205 (in step S207). The gain (gain(t)) is a gain that is used to suppress the result of the synchronous subtraction performed in step S203. For example, the process of step S207 can be performed using the aforementioned Equation (7).

Subsequently, the smoothing unit 250 smoothes the gain (gain(t)) calculated in step S207 (in step S208). For example, the process of step S208 can be performed using the aforementioned Equation (8).

Next, the multiplier 260 outputs a signal (out(t)) processed by multiplying the result of the synchronous subtraction performed in step S203 by the gain obtained in step S208 (in step S209). For example, the process of step S209 can be performed using the following Equation (12).

$$\mathrm{out}(t)=\mathrm{gain_mem}(t)\times tmp2(t) \tag{12}$$

When the process of step S209 is completed, the sound processing apparatus 200 causes the process to return to the aforementioned step S202. In addition, the sound processing apparatus 200 repeatedly performs the processes of steps S202 to S209 illustrated in FIG. 6 until power supply is stopped or until the sound processing apparatus 200 receives an instruction to terminate the process. The order of the processes illustrated in FIG. 6 can be changed when necessary so that there is no discrepancy in the contents of the processes.

Effects of Second Embodiment

As described above, the sound processing apparatus 200 performs the process of highlighting a sound (such as a user's sound) to be saved and calculates a gain using a signal including the highlighted sound. According to the second embodiment, the sound processing apparatus 200 can highlight a sound such as a user's sound more largely than the first embodiment. As a result, it is possible to prevent a degradation of the quality of a signal (to be provided to the device) more reliably than the first embodiment.

Third Embodiment

The first and second embodiments describe that one of the sound input units that are the omnidirectional microphones is arranged on the side of the region at which a signal of a sound (such as stationary noise) to be suppressed arrives and the other is arranged on the side of the region at which a signal of a sound (such as a user's sound) to be saved arrives. The first and second embodiments, however, are not limited to this. In the first and second embodiments, the sound input units may be arranged on respective sides from which signals of sounds to be saved comes, and signals that are acquired from the sound input units may be suppressed using a gain.

Configuration of Sound Processing Apparatus (Third Embodiment)

Figure 7:
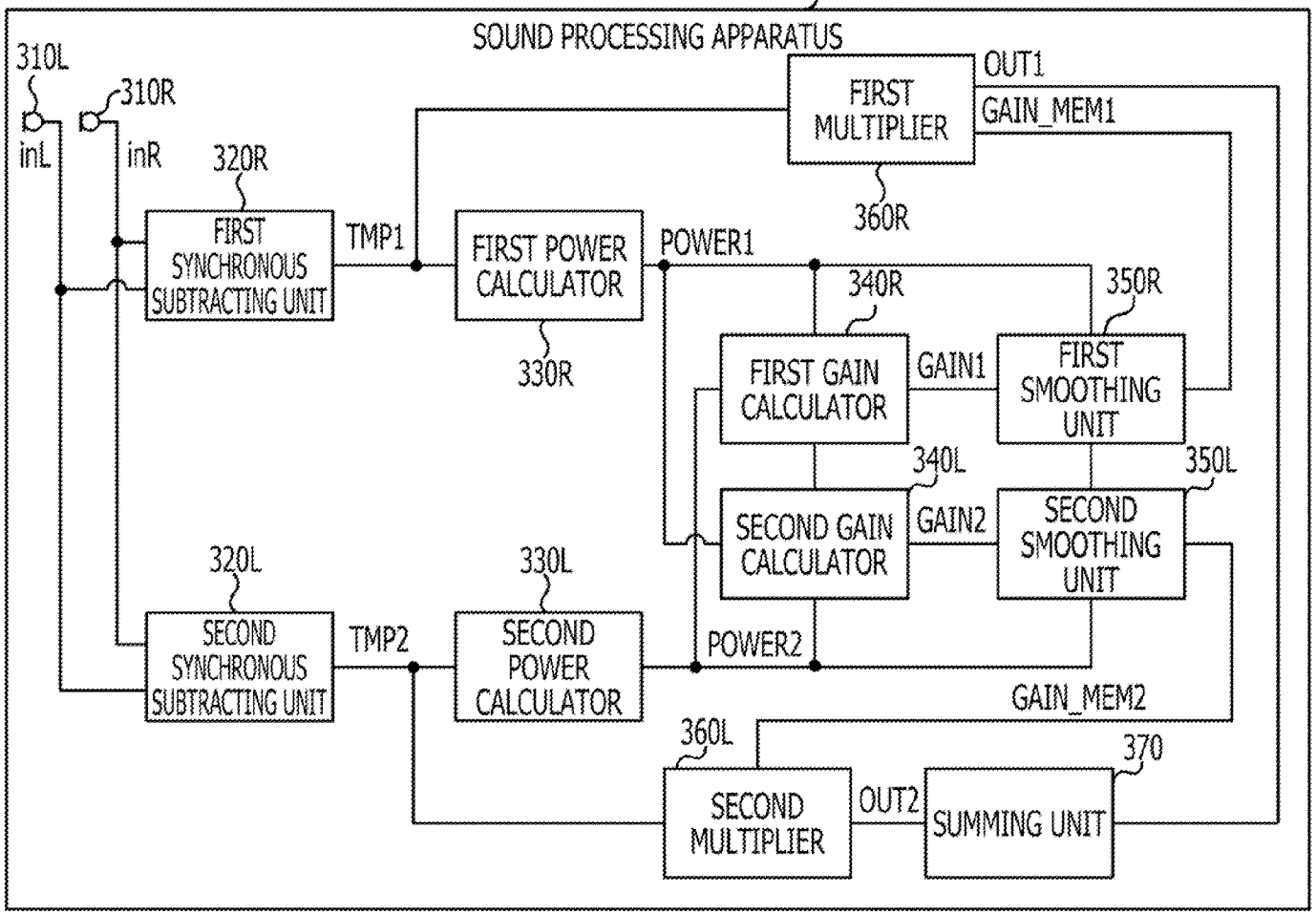
FIG. 7 is a functional block diagram illustrating a functional configuration of a sound processing apparatus according to a third embodiment.

FIG. 7 is a functional block diagram illustrating a configuration of a sound processing apparatus according to a third embodiment. As illustrated in FIG. 7, the sound processing apparatus 300 according to the third embodiment has the configuration that is substantially the same as or similar to a configuration formed by making the configuration of the sound processing apparatus 100 illustrated in FIG. 2 redundant, for example.

As illustrated in FIG. 7, a sound input unit 310R and a sound input unit 310L are omnidirectional microphones in substantially the same manner as the first embodiment, for example. The sound processing unit 310R is arranged on the side of a region at which a sound that corresponds to a sound of a user A mainly arrives, for example. The sound processing unit 310L is arranged on the side of a region at which a sound that corresponds to a sound of a user B mainly arrives, for example. The user A and the user B are different.

A first synchronous subtracting unit 320R synchronously subtracts a signal input to the sound input unit 310L from a signal input to the sound input unit 310R for the purpose of obtaining a signal formed by highlighting a sound that has arrived from the side of the sound input unit 310R. The first synchronous subtracting unit 320R performs the synchronous subtraction in the same manner as the synchronous subtracting unit 120 according to the first embodiment and the like. For example, the first synchronous subtracting unit 320R stands by until it is time to convert the signals input to the sound input units 310R and 310L into digital signals in accordance with a predetermined sampling frequency. When it is time to convert the signals into the digital signals, the first synchronous subtracting unit 320R acquires the signal (inR) input to the sound input unit 310R and the signal (inL) input to the sound input unit 310L.

When the first synchronous subtracting unit 320R synchronously subtracts the signal input to the sound input unit 310L from the signal input to the sound input unit 310R, to the signals are synchronized with each other. Thus, when signals that correspond to substantially the same sound are input to the sound input units 310R and 310L, the first synchronous subtracting unit 320R calculates the difference between the numbers of samples on the basis of an acoustic velocity, an interval between the sound input unit 310R and the sound input unit 310L, and a sampling frequency. It is assumed that the first synchronous subtracting unit 320R performs the calculation and thereby determines that a signal that is substantially the same as the signal input to the sound input unit 310L is input to the sound input unit 310R after one sampling interval. In this assumption, the first synchronous subtracting unit 320R acquires a signal inR(t) of a sample number "t" and a signal inL(t−1) of a sample number "t−1" that precedes the sample number "t" by one sampling interval. Then, the first synchronous subtracting unit 320R subtracts the signal inL(t−1) of the sample number "t−1" from the signal inR(t) of the sample number "t".

A second synchronous subtracting unit 320L synchronously subtracts the signal input to the sound input unit 310R from the signal input to the sound input unit 310L in substantially the same manner as the first synchronous subtracting unit 320R. For example, the second synchronous subtracting unit 320L subtracts a signal inR(t−1) of the sample number "t−1" from a signal inL(t) of the sample number "t".

A first power calculator 330R calculates power of the result (tmp1) of the synchronous subtraction performed by the first synchronous subtracting unit 320R in substantially the same manner as the synchronous subtracting unit 120 according to the first embodiment and the like. For example, the first power calculator 330R calculates power (Power1) by squaring the result (tmp1) of the synchronous subtraction.

A second power calculator 330L calculates power of the result (tmp2) of the synchronous subtraction in substantially the same manner as the first power calculator 330R. For example, the second power calculator 330L calculates the power of the result (tmp2) of the synchronous subtraction performed by the second synchronous subtracting unit 320L. For example, the second power calculator 330L calculates power (Power2) by squaring the result (tmp2) of the synchronous subtraction.

A first gain calculator 340R calculates a gain (gain1) using the power (Power1) of the result (tmp1) of the synchronous subtraction and the power (Power2) of the result (tmp2) of the synchronous subtraction, while the gain (gain1) is used to suppress the result (tmp1) of the synchronous subtraction. The first gain calculator 340R calculates the gain (gain1) in substantially the same manner as the gain calculator 140 according to the first embodiment. For example, the first gain calculator 340R subtracts the power (Power2) (calculated by the second power calculator 330L) of the result (tmp2) of the synchronous subtraction from the power (Power1) (calculated by the first power calculator 330R) of the result (tmp1) of the synchronous subtraction. Then, the first gain calculator 340R calculates the gain (gain1) by calculating the square root of a value obtained by dividing the result (Power12) of the subtraction by the power (Power1) of the result (tmp1) of the synchronous subtraction. The gain (gain1) calculated by the first gain calculator 340R is expressed by the following Equation (13), for example.

$$\text{gain1}=(\text{Power12}\div\text{Power1})^{0.5} \tag{13}$$

A second gain calculator 340L calculates a gain (gain2) using the power (Power1) of the result (tmp1) of the synchronous subtraction and the power (Power2) of the result (tmp2) of the synchronous subtraction, while the gain (gain2) is used to suppress the result (tmp2) of the synchronous subtraction. The second gain calculator 340L calculates the gain (gain2) in substantially the same manner as the first gain calculator 340R. For example, the second gain calculator 340L subtracts the power (Power1) (calculated by the first power calculator 330R) of the result (tmp1) of the synchronous subtraction from the power (Power2) (calculated by the second power calculator 330L) of the result (tmp2) of the synchronous subtraction. Then, the second gain calculator 340L calculates the gain (gain2) by calculating the square root of a value obtained by dividing the result (Power21) of the subtraction by the result (tmp2) of the synchronous subtraction. The gain (gain2) calculated by the second gain calculator 340L is expressed by the following Equation (14), for example.

$$\text{gain2}=(\text{Power21}\div\text{Power2})^{0.5} \tag{14}$$

A first smoothing unit 350R smoothes the gain (gain1) calculated by the first gain calculator 340R in substantially the same manner as the smoothing unit 150 according to the first embodiment. The gain (gain_mem1) smoothed by the first smoothing unit 350R is expressed by the following Equation (15).

$$gain_mem1=\alpha\times gain_mem1'+(1-\alpha)\times gain1 \quad (15)$$

In Equation (15), $\alpha$ is a coefficient that is set by the first smoothing unit 350R so that $0\leq\alpha<1$. In addition, in Equation (15), "gain_mem1'" is a gain that is smoothed in a process performed on a processed signal of the previous sample number.

A second smoothing unit 350L smoothes the gain (gain2) calculated by the second gain calculator 340L in substantially the same manner as the first smoothing unit 350R. The gain (gain_mem2) smoothed by the second smoothing unit 350L is expressed by the following Equation (16).

$$gain_mem2=\alpha\times gain_mem2'+(1-\alpha)\times gain2 \quad (16)$$

In Equation (16), $\alpha$ is a coefficient that is set by the second smoothing unit 350L so that $0\leq\alpha<1$. In addition, in Equation (16), "gain_mem2'" is a gain smoothed in a process performed on the processed signal of the previous sample number.

A first multiplier 360R processes the result (tmp1) of the synchronous subtraction using the gain (gain_mem1) smoothed by the first smoothing unit 350R in substantially the same manner as the multiplier 160 according to the first embodiment. Specifically, the first multiplier 360R suppresses and processes the result (tmp1) of the synchronous subtraction by multiplying the result (tmp1) of the synchronous subtraction by the gain (gain_mem1) smoothed by the first smoothing unit 350R. Thus, noise that is included in the result (tmp1) of the synchronous subtraction is suppressed. Then, the first multiplier 360R outputs the suppression result (out1).

A second multiplier 360L processes the result (tmp2) of the synchronous subtraction using the gain (gain_mem2) smoothed by the second smoothing unit 350L in the same manner as the first multiplier 360R. Specifically, the second multiplier 360L suppresses and processes the result (tmp2) of the synchronous subtraction by multiplying the result (tmp2) of the synchronous subtraction by the gain (gain_mem2) smoothed by the second smoothing unit 350L. Thus, noise that is included in the result (tmp2) of the synchronous subtraction is suppressed. Then, the second multiplier 360L outputs the suppression result (out2).

A summing unit 370 sums the suppression result (out1) output by the first multiplier 360R and the suppression result (out2) output by the second multiplier 360L and outputs the sum of the results.

The sound processing apparatus 300 illustrated in FIG. 7 includes a storage unit (not illustrated) such as a semiconductor memory element that is a random access memory (RAM), a flash memory or the like. In addition, the sound processing apparatus 300 illustrated in FIG. 7 has a controller (not illustrated) that controls the aforementioned functional parts. The controller corresponds to an electronic circuit or an integrated circuit. The electronic circuit or the integrated circuit uses the storage unit and controls the processes that are performed by the functional parts. Examples of the electronic circuit are a central processing unit (CPU) and a micro processing unit (MPU). Examples of the integrated circuit are an application specific integrated circuit (ASIC) and a field programmable gate array (FPGA).

Process to be Performed by Sound Processing Apparatus (Third Embodiment)

Figure 8:
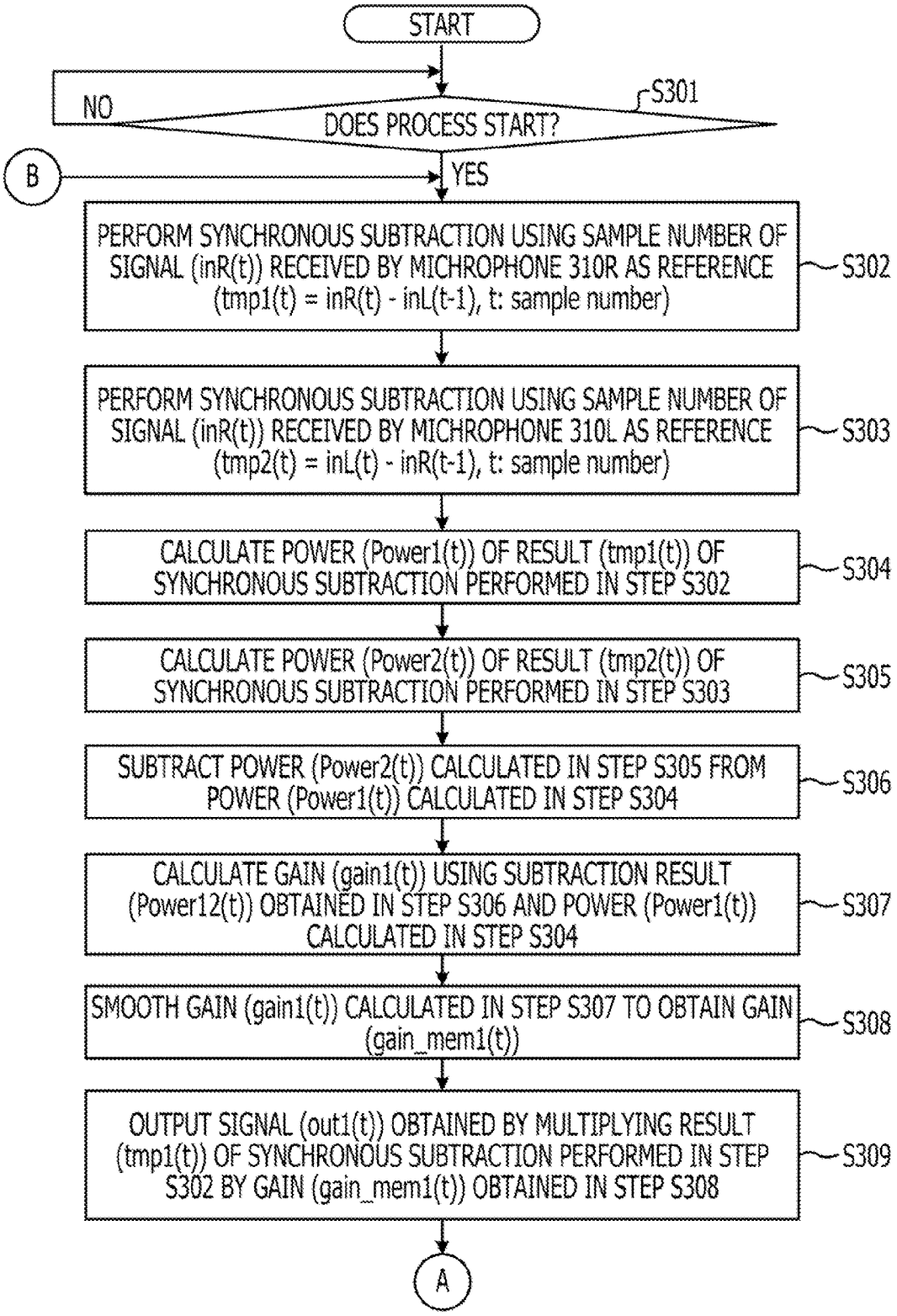
FIG. 8 is a diagram illustrating the flow of a process that is performed by the sound processing apparatus according to the third embodiment.
Figure 9:
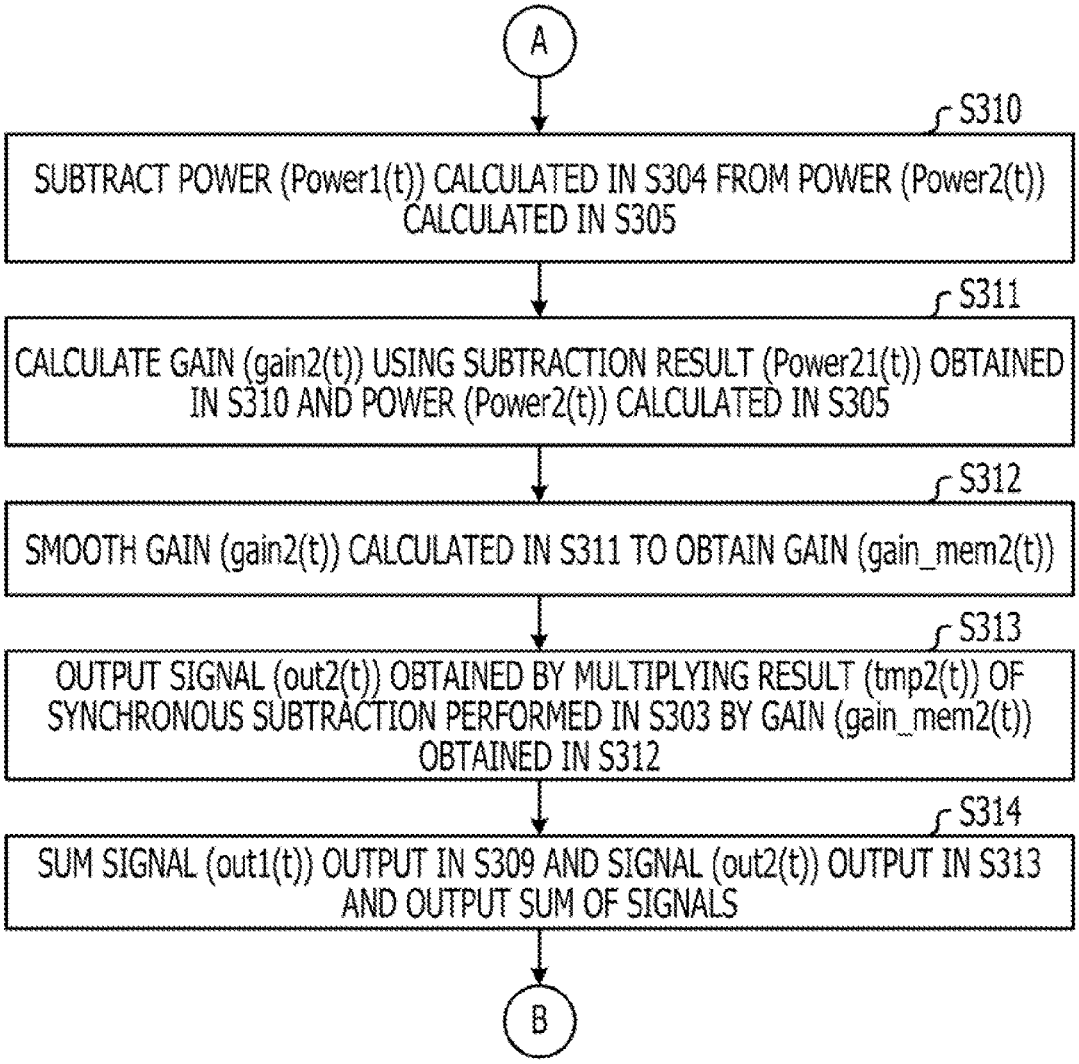
FIG. 9 is a diagram illustrating the flow of the process that is performed by the sound processing apparatus according to the third embodiment.

Next, the flow of a process that is performed by the sound processing apparatus 300 according to the third embodiment is described with reference to FIGS. 8 and 9. FIGS. 8 and 9 are diagrams illustrating the flow of the process that is performed by the sound processing apparatus according to the third embodiment. In the following description using FIGS. 8 and 9, "microphones" correspond to the aforementioned sound input units.

As illustrated in FIG. 8, the controller of the sound processing apparatus 300 or the like determines whether or not the process starts (in step S301). For example, the controller of the sound processing apparatus 300 or the like determines whether or not the process starts on the basis of whether or not the sound processing apparatus 300 has received an instruction to start the process. When the controller of the sound processing apparatus 300 or the like determines that the process does not start (No in step S301), the controller of the sound processing apparatus 300 or the like repeatedly determines whether or not the process starts.

On the other hand, when the controller of the sound processing apparatus 300 or the like determines that the process starts (Yes in step S301), the first synchronous subtracting unit 320R performs the next process of step S302. Specifically, the first synchronous subtracting unit 320R performs the synchronous subtraction using the sample number of the signal (inR(t)) received by the microphone 310R as a reference (in step S302). For example, the process of step S302 can be performed using the aforementioned Equation (3).

Next, the second synchronous subtracting unit 320L performs the synchronous subtraction using the sample number of the signal received by the microphone 310L as a reference (in step S303). For example, the process of step S303 can be performed using the aforementioned Equation (10).

Subsequently, the first power calculator 330R calculates power (Power1(t)) of the result of the synchronous subtraction performed in step S302 (in step S304). For example, the process of step S304 can be performed using the aforementioned Equation (4).

Next, the second power calculator 330L calculates power (Power2(t)) of the result of the synchronous subtraction performed in step S303 (in step S305). For example, the process of step S305 can be performed using the aforementioned Equation (11).

Then, the first gain calculator 340R subtracts the power (Power2(t)) calculated in step S305 from the power (Power1(t)) calculated in step S304 (in step S306). For example, the process of step S306 can be performed using the following Equation (17).

$$Power12(t)=Power1(t)-Power2(t) \quad (17)$$

In Equation (17), Power12(t) is the subtraction result obtained in the process of step S306.

Next, the first gain calculator 340R calculates a gain (gain1(t)) using the subtraction result (Power12(t)) obtained in step S306 and the power (Power1(t)) calculated in step S304 (in step S307). The gain (gain1(t)) is a gain that is used to suppress the result of the synchronous subtraction performed in step S302. For example, the process of step S307 can be performed using the following Equation (18).

$$gain1(t)=(Power12(t)\div Power1(t))^{0.5} \quad (18)$$

Subsequently, the first smoothing unit 350R smoothes the gain calculated in step S307 (in step S308). For example, the process of step S308 can be performed using the following Equation (19).

$$gain_mem1(t)=\alpha\times gain_mem1(t-1)+(1-\alpha)\times gain1(t) \quad (19)$$

Next, the first multiplier 360R outputs a signal (out1(t)) obtained by multiplying the result of the synchronous subtraction performed in step S302 by the gain obtained in step S308 (in step S309). For example, the process of step S309 can be performed using the following Equation (20).

$$out1(t)=gain_mem1(t)\times tmp1(t) \quad (20)$$

Then, as illustrated in FIG. 9, the second gain calculator 340L subtracts the power (Power1(t)) (calculated in step S304) of the result of the synchronous subtraction from the power (Power2(t)) (calculated in step S305) of the result of the synchronous subtraction (in step S310). For example, the process of step S310 can be performed using the aforementioned Equation (6).

Next, the second gain calculator 340L calculates a gain (gain2(t)) using the subtraction result (Power21(t)) obtained in step S310 and the power (Power2(t)) (calculated in step S305) of the result of the synchronous subtraction (in step S311). The gain (gain2(t)) is a gain that is used to suppress the result of the synchronous subtraction performed in step S303. For example, the process of step S311 can be performed using the following Equation (21).

$$gain2(t)=(Power21(t)\div Power2(t))^{0.5} \quad (21)$$

Subsequently, the second smoothing unit 350L smoothes the gain calculated in step S311 (in step S312). For example, the process of step S312 can be performed using the following Equation (22).

$$gain_mem2(t)=\alpha\times gain_mem2(t-1)+(1-\alpha)\times gain2(t) \quad (22)$$

Next, the second multiplier 360L outputs a signal (out2(t)) obtained by multiplying the result of the synchronous subtraction performed in step S303 by the gain obtained in step S312 (in step S313). For example, the process of step S313 can be performed using the following Equation (23).

$$out2(t)=gain_mem2(t)\times tmp2(t) \quad (23)$$

Subsequently, the summing unit 370 sums the signal (out1) output in step S309 and the signal (out2) output in step S313 and outputs the sum of the signals (in step S314).

When the process of step S314 is completed, the sound processing apparatus 300 causes the process to return to the aforementioned step S302. In addition, the sound processing apparatus 300 repeatedly performs the processes of steps S302 to S314 until power supply is stopped or until the sound processing apparatus 300 receives an instruction to terminate the process. The order of the processes illustrated in FIGS. 8 and 9 can be changed when necessary so that there is no discrepancy in the contents of the processes.

Effects of Third Embodiment

As described above, the sound processing apparatus 300 has the sound input units arranged on the sides from which sounds to be saved come, and the sound processing apparatus 300 uses gains to suppress sounds acquired from the sound input units. According to the third embodiment, it is possible to highlight signals acquired from the sound input units arranged on the different sides and substantially prevent degradations of the qualities of the signals that have been acquired from the sound input units and are provided to the device.

Fourth Embodiment

In the aforementioned embodiment, the omnidirectional microphones each have equal sensitivities in all directions in the range of 360 degrees and collect sounds, and each of the synchronous subtracting units performs the synchronous subtraction process on the collected sound for a certain purpose. However, the embodiment is not limited to this. Directional microphones may be used instead of the omnidirectional microphones and the synchronous subtracting units.

Configuration of Sound Processing Apparatus (Fourth Embodiment)

Figure 10:
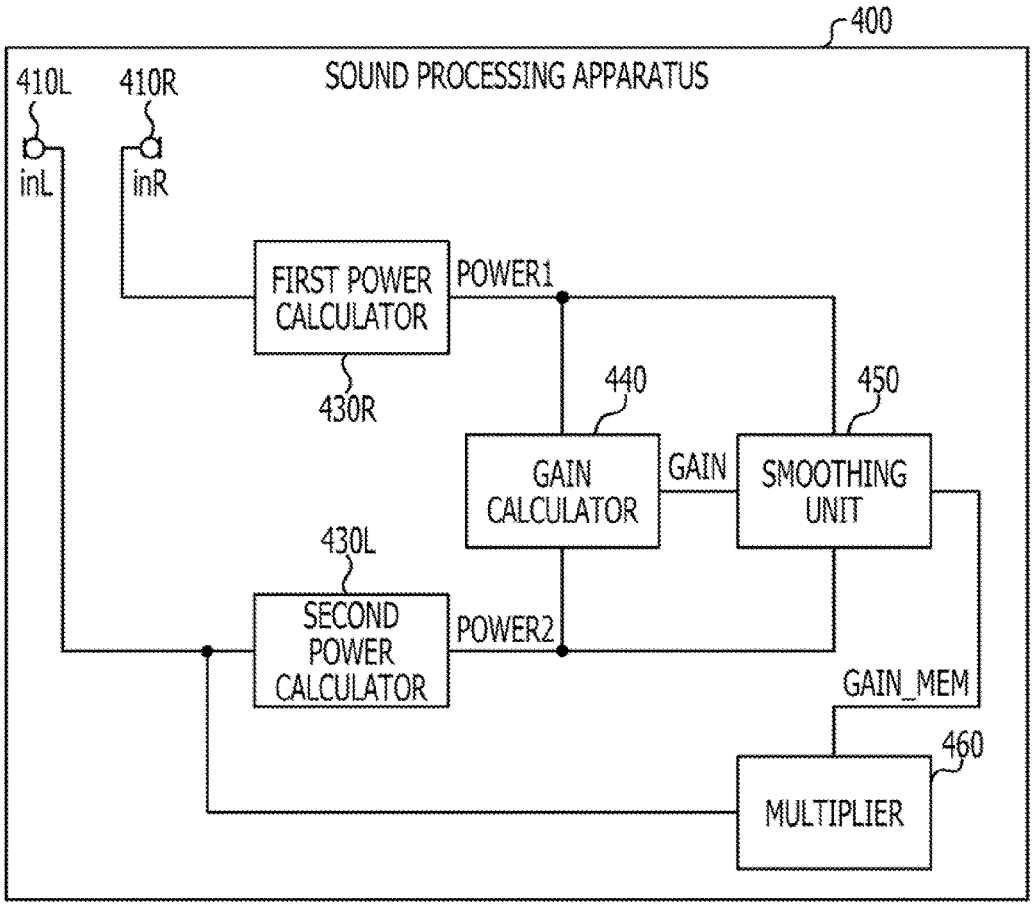
FIG. 10 is a functional block diagram illustrating a functional configuration of a sound processing apparatus according to a fourth embodiment.

FIG. 10 is a functional block diagram illustrating a configuration of a sound processing apparatus according to a fourth embodiment. As illustrated in FIG. 10, the sound processing apparatus 400 according to the fourth embodiment has substantially the same configuration as the sound processing apparatus 200 according to the second embodiment, for example. Specifically, a first power calculator 430R corresponds to the first power calculator 230R. A second power calculator 430L corresponds to the second power calculator 230L. A gain calculator 440 corresponds to the gain calculator 240. A smoothing unit 450 corresponds to the smoothing unit 250. A multiplier 460 corresponds to the multiplier 260.

The sound processing apparatus 400 according to the fourth embodiment is different in the following features from the sound processing apparatus 200 according to the fourth embodiment. Specifically, the sound processing apparatus 400 according to the fourth embodiment has a sound input unit 410R and a sound input unit 410L instead of the sound input units 210R and 210L (that are the omnidirectional microphones) and the synchronous subtracting units 220R and 220L. The sound input unit 410R and the sound input unit 410L are directional microphones. The fourth embodiment describes the case in which the sound input unit 410R is arranged on the side of a region at which noise (such as stationary noise) to be suppressed mainly arrives and the sound input unit 410L is arranged on the side of a region at which a sound (such as a user's sound) to be saved arrives. The flow of a process that is performed by the sound processing apparatus 400 according to the fourth embodiment is described below with reference to FIG. 11.

Process to be Performed by Sound Processing Apparatus (Fourth Embodiment)

Figure 11:
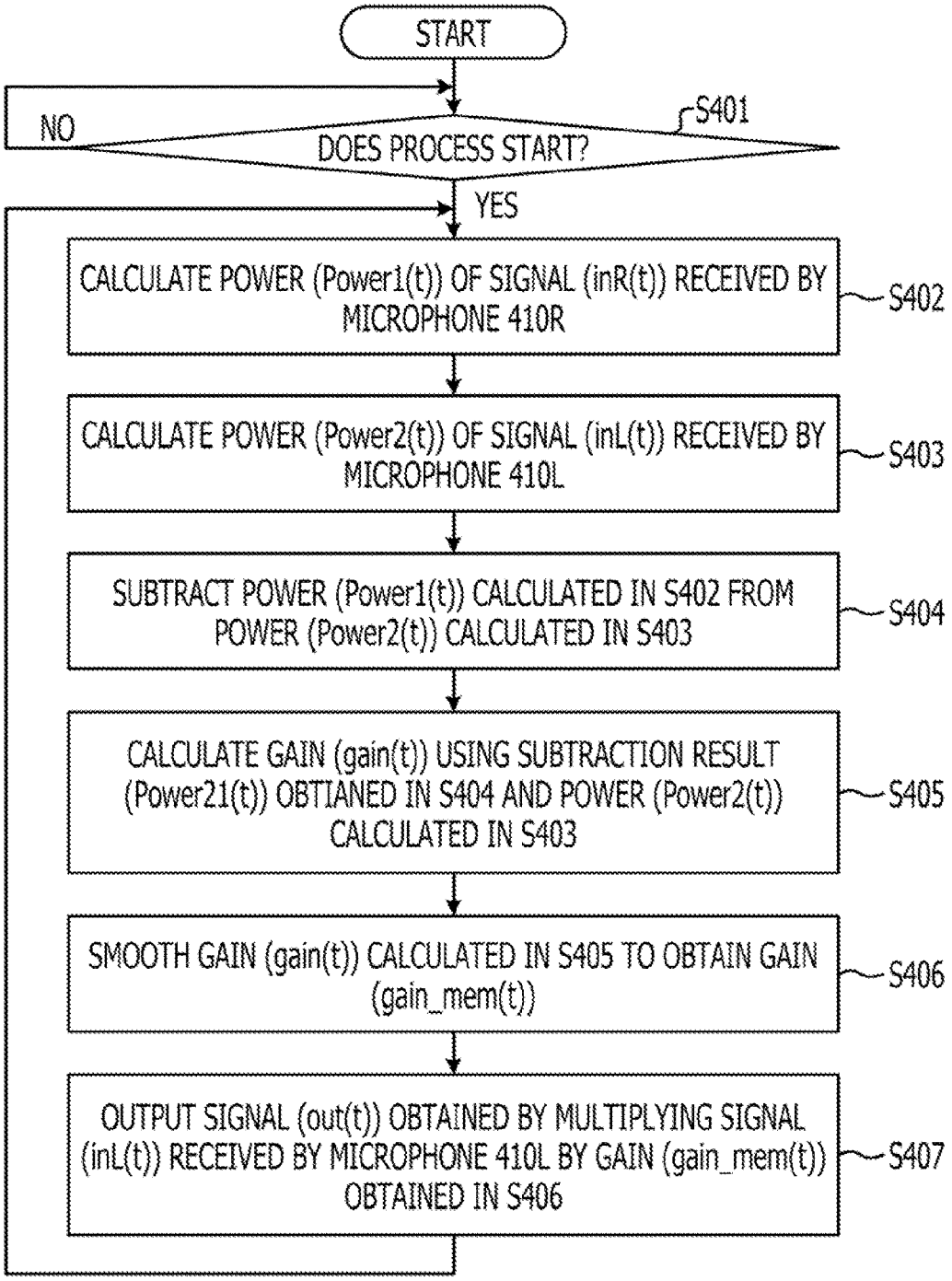
FIG. 11 is a diagram illustrating the flow of a process that is performed by the sound processing apparatus according to the fourth embodiment.

The flow of the process that is performed by the sound processing apparatus 400 according to the fourth embodiment is described with reference to FIG. 11. FIG. 11 is a diagram illustrating the flow of the process that is performed by the sound processing apparatus according to the fourth embodiment. In the following description using FIG. 11, "microphones" correspond to the aforementioned sound input units.

As illustrated in FIG. 11, a controller of the sound processing apparatus 400 or the like determines whether or not the process starts (in step S401). When the controller of the sound processing apparatus 400 or the like determines that the process does not start (No in step S401), the controller of the sound processing apparatus 400 or the like repeatedly determines whether or not the process starts.

On the other hand, when the controller of the sound processing apparatus 400 or the like determines that the process starts (Yes in step S401), the first power calculator 430R performs the next process of step S402. Specifically, the first power calculator 430R calculates power (Power1(t)) of a signal (inR(t)) received by the microphone 410R (in step S402). For example, the process of step S402 can be performed using the following Equation (24).

$$\text{Power1}(t)=\Sigma \text{in}R(t)^2 \quad (24)$$

Next, the second power calculator 430L calculates power (Power2(t)) of a signal (inL(t)) received by the microphone 410L (in step S403). For example, the process of step S403 can be performed using the following Equation (25).

$$\text{Power2}(t)=\Sigma \text{in}L(t)^2 \quad (25)$$

Subsequently, the gain calculator 440 subtracts the power calculated in step S402 from the power calculated in step S403 (in step S404). For example, the process of step S404 can be performed using the aforementioned Equation (6).

Next, the gain calculator 440 calculates a gain (gain(t)) using the subtraction result (Power21(t)) obtained in step S404 and the power (Power2(t)) calculated in step S403 (in step S405). The gain (gain(t)) is a gain that is used to suppress noise included in the signal received by the microphone 410L. For example, the process of step S405 can be performed using the aforementioned Equation (7).

Subsequently, the smoothing unit 450 smoothes the gain (gain(t)) calculated in step S405 (in step S406). For example, the process of step S406 can be performed using the aforementioned Equation (8).

Next, the multiplier 460 outputs a signal (out(t)) processed by multiplying the signal (inL(t)) received by the microphone 410L by the gain (gain_mem(t)) smoothed in step S406 (in step S407). For example, the process of step S407 can be performed using the aforementioned Equation (9).

When the process of step S407 is completed, the sound processing apparatus 400 causes the process to return to the aforementioned step S402. In addition, the sound processing apparatus 400 repeatedly performs the processes of steps S402 to S407 until power supply is stopped or until the sound processing apparatus 400 receives an instruction to terminate the process. The order of the processes illustrated in FIG. 11 can be changed when necessary so that there is no discrepancy in the contents of the processes.

Effect of Fourth Embodiment

As described above, according to the fourth embodiment, even when the directional microphones are used, it is possible to substantially reduce a delay of the process, compared to the technique for processing an input signal on a frequency axis.

Fifth Embodiment

Another embodiment of the sound processing program disclosed herein and the sound processing apparatus disclosed herein is described below.

(1) Configuration of Apparatus and the Like

For example, the configuration of the functional blocks of the sound processing apparatus 100 illustrated in FIG. 2 is a conceptual configuration, and the functional blocks may not be physically configured as illustrated in FIG. 2. For example, the gain calculator 140 and the smoothing unit 150, which are illustrated in FIG. 2, may be functionally or physically integrated with each other. In this manner, all or a part of the functional blocks of the sound processing apparatus 100 can be functionally or physically separated or integrated on an arbitrary basis, depending on loads of the functional blocks and usage states of the functional blocks.

(2) Installation of Apparatus into Another Device

Figure 12:
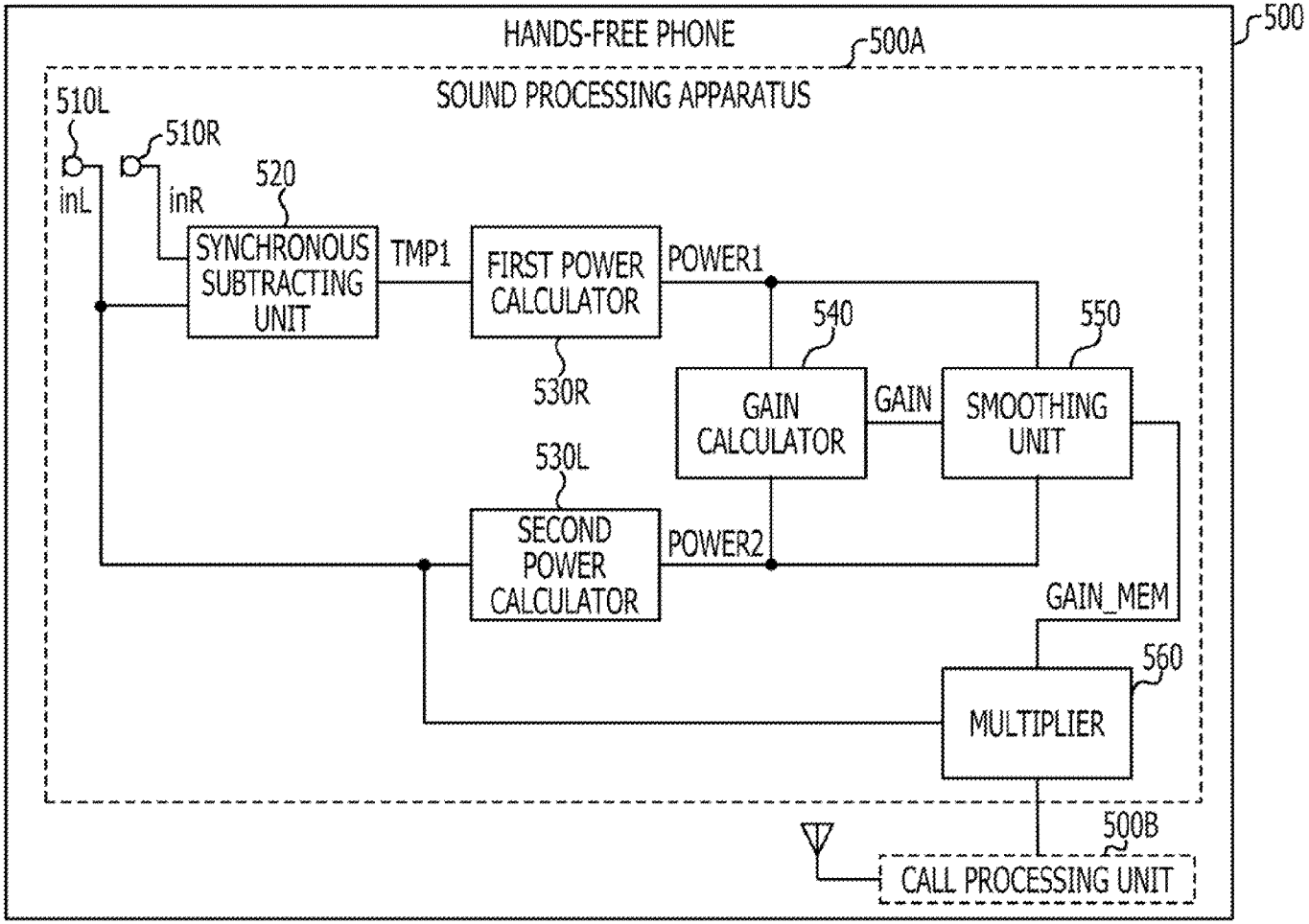
FIG. 12 is a functional block diagram illustrating a functional configuration of a hands-free phone that has, installed therein, the sound processing apparatus according to the first embodiment.
Figure 13:
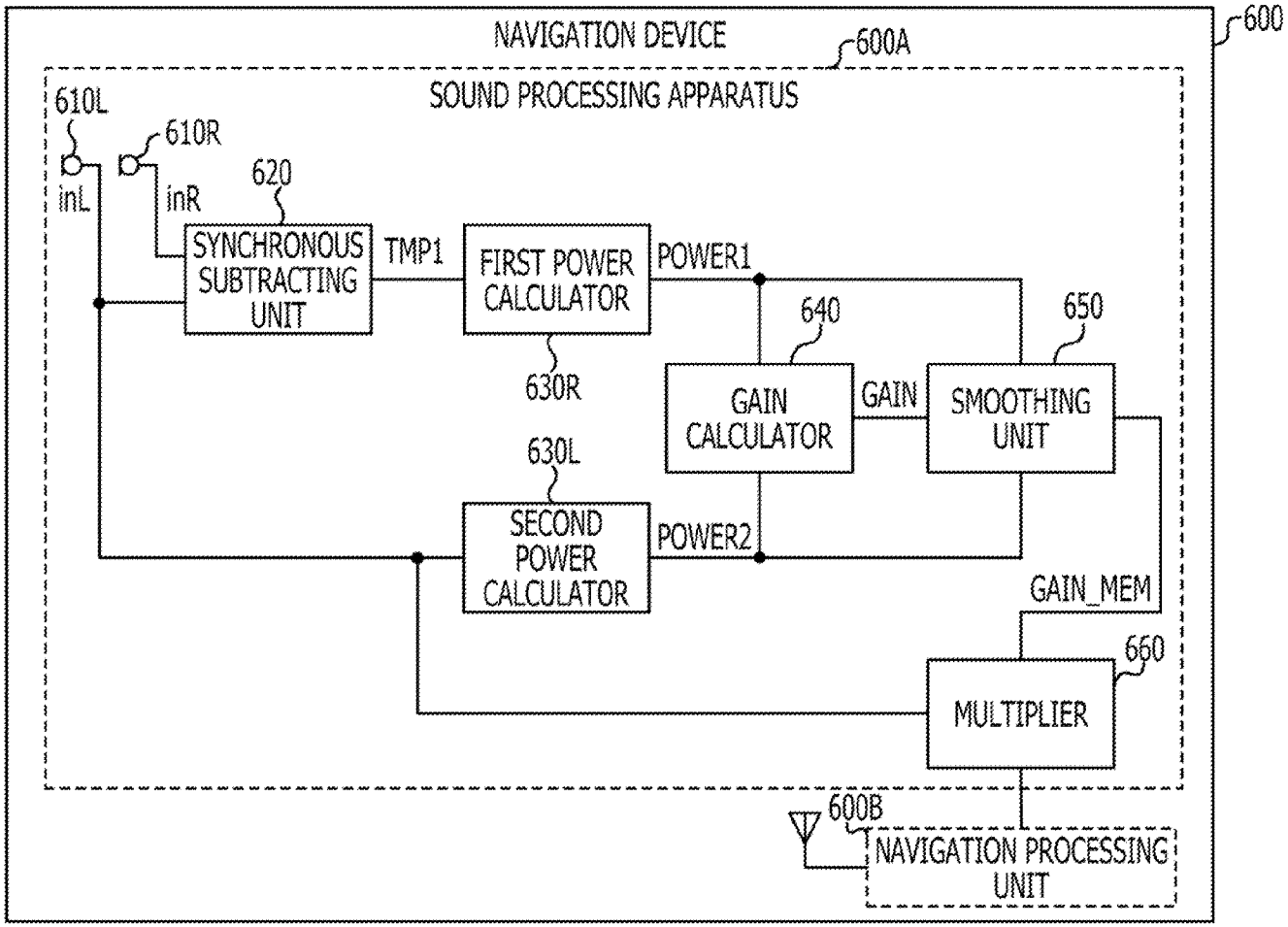
FIG. 13 is a functional block diagram illustrating an example of a functional configuration of a navigation device that has, installed therein, the sound processing apparatus according to the first embodiment.

For example, the sound processing apparatus according to each of the aforementioned embodiments can be installed in a hands-free phone, a navigation device and the like. FIG. 12 illustrates an example in which the sound processing apparatus is installed in a hands-free phone, while FIG. 13 illustrates an example in which the sound processing apparatus is installed in a navigation device. FIG. 12 is a functional block diagram illustrating a configuration of the hands-free phone that includes the sound processing apparatus according to the first embodiment. FIG. 13 is a functional block diagram illustrating an example of a configuration of the navigation device that includes the sound processing apparatus according to the first embodiment.

For example, as illustrated in FIG. 12, a sound processing apparatus 500A that corresponds to the aforementioned embodiment may be installed in a hands-free phone 500 and may output a signal processed by the sound processing apparatus 500A to a call processing unit 500B. For example, as illustrated in FIG. 13, a sound processing apparatus 600A that corresponds to the aforementioned embodiment may be installed in a navigation device 600 and may output a signal processed by the sound processing apparatus 600A to a navigation processing unit 600B.

(3) Sound Processing Program

The various processes that are performed by the sound processing apparatus according to each of the embodiments can be achieved by causing an electronic device such as a microprocessor to execute a predetermined program.

Figure 14:
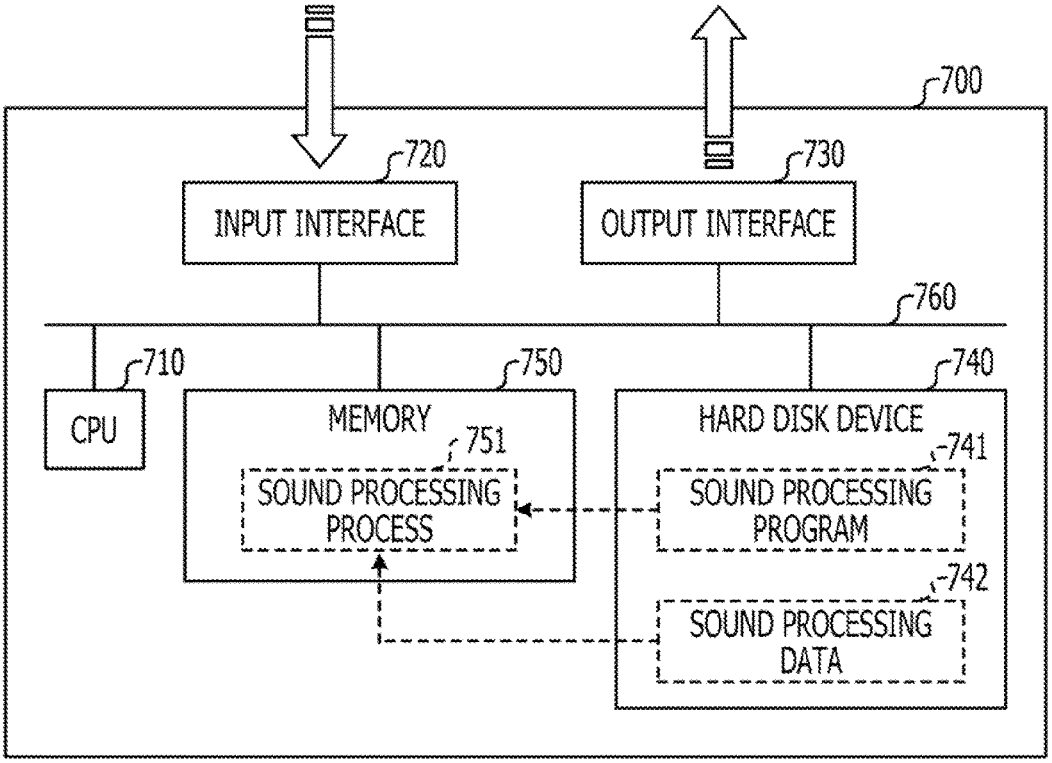
FIG. 14 is a diagram illustrating an example of an electronic device that executes a sound processing program.

An example of a computer that executes the sound processing program is described below with reference to FIG. 14, while the sound processing program achieves substantially the same functions as the processes that are performed by the sound processing apparatus according to each of the aforementioned embodiments. FIG. 14 is a diagram illustrating an example of an electronic device that executes the sound processing program.

As illustrated in FIG. 14, an electronic device 700 has a central processing unit (CPU) 710 and achieves the various processes that are performed by the sound processing apparatus according to each of the aforementioned embodiments. The CPU 710 executes various types of processing. As illustrated in FIG. 14, the electronic device 700 also has an input interface 720 for receiving a signal and an output interface 730 for outputting a processed signal.

As illustrated in FIG. 14, the electronic device 700 includes a hard disk device 740 and a memory 750. The hard disk device 740 stores data and a program that enables the CPU 710 to execute various processes. The memory 750 may be a random access memory (RAM) or the like and temporarily stores various types of information. The devices 710 to 750 are connected to each other through a bus 760.

An electronic circuit (such as a micro processing unit (MPU)) and an integrated circuit (such as an application specific integrated circuit (ASIC) or a field programmable gate array (FPGA)) can be used instead of the CPU 710. A semiconductor memory element such as a flash memory can be used instead of the memory 750.

A sound processing program 741 and sound processing data 742 may be stored in the hard disk device 740. The sound processing program 741 can achieve substantially the same functions as the functions of the sound processing apparatus according to each of the aforementioned embodiments. The sound processing program 741 can be distributed through a network to a storage unit of another computer and stored in the storage unit of the other computer when necessary, while the other computer is connected to the electronic device 700 through the network so that the electronic device 700 can communicate with the other computer.

The CPU 710 reads the sound processing program 741 from the hard disk device 740 and loads the read sound processing program 741 into the memory 750 such as a RAM, and whereby the sound processing program 741 functions as an sound processing process 751 as illustrated in FIG. 14. The sound processing process 751 causes various types of data such as the sound processing data 742 read from the hard disk device 740 to be loaded into regions that are arranged on the memory 750 and to which the data has been assigned. The sound processing process 751 causes the various types of the processes to be performed on the basis of the various types of the loaded data.

The sound processing process 751 includes the processes that are performed by the synchronous subtracting unit 120, the first power calculator 130R, the second power calculator 130L, the gain calculator 140, the smoothing unit 150 and the multiplier 160, which are included in the sound processing apparatus 100 illustrated in FIG. 2, for example. For example, the sound processing process 751 includes the processes illustrated in FIG. 4 and the like.

The sound processing program 741 is stored in a storage medium. The hard disk device 740 does not need to have the sound processing program 741 stored therein. For example, the programs may be stored in a computer-readable recording medium ("portable physical medium"), such as a flexible disk (FD), a CD-ROM, a DVD disc, a magnetooptical disc or an IC card, while the electronic device 700 can read and write data from and in the portable physical medium. The electronic device 700 may read the programs from the portable physical medium and execute the programs. However, the storage medium does not include a transitory medium such as a propagation signal.

In addition, the programs may be stored in another computer (or a server) that is connected through a public line, the Internet, a LAN, a WAN or the like to an ECU having the electronic device 700 installed therein. The electronic device 700 may read the programs from the other computer (or the server) and execute the programs.

In the aforementioned embodiments, the first power calculator 130R, the first power calculator 230R, the first power calculator 330R and the first power calculator 430R are examples of a first calculator. In addition, the second power calculator 130L, the second power calculator 230L, the second power calculator 330L and the second power calculator 430L are examples of a second calculator. In addition, the gain calculator 140, the gain calculator 240, the first gain calculator 340R, the second gain calculator 340L and the gain calculator 440 are examples of a gain calculator. In addition, the multiplier 160, the multiplier 260, the first multiplier 360R, the second multiplier 360L and the multiplier 460 are examples of a multiplier. In addition, the smoothing unit 150, the smoothing unit 250, the first smoothing unit 350R, the second smoothing unit 350L and the smoothing unit 450 are examples of a smoothing unit. All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A sound processing apparatus comprising:

a memory; and a processor coupled to the memory and configured to:

receive a first signal from a first microphone and a second signal from a second microphone;

process a first synchronous subtraction based on a first sample of the first signal and a second sample of the second signal;

process a second synchronous subtraction based on a first sample of the second signal and a second sample of the first signal;

calculate a first power based on a result of the first synchronous subtraction;

calculate a second power based on at a result of the second synchronous subtraction;

calculate a first gain based on the first power and a difference between the first power and the second power;

smooth the first gain;

process a combined result by multiplying the first synchronous subtraction by the smoothed first gain; and output the combined result.

2. The sound processing apparatus according to claim 1, wherein the first microphone and the second microphone are omnidirectional microphones.

3. The sound processing apparatus according to claim 1, wherein the first synchronous subtraction is calculated by subtracting the second signal from the first signal in synchronization with a certain interval between a first input of a sound into the first microphone and a second input of the sound into the second microphone.

4. The sound processing apparatus according to claim 1, wherein the second synchronous subtraction is calculated by subtracting the first signal from the second signal in synchronization with a certain interval between a first input of a sound into the first microphone and a second input of the sound into the second microphone.

5. The sound processing apparatus according to claim 1, wherein the first microphone picks up a target sound, and the sound microphone picks up a noise prior to the target sound.

6. A sound processing method comprising:

receiving a first signal from a first microphone and a second signal from a second microphone;

processing, by circuitry, a first synchronous subtraction based on a first sample of the first signal and a second sample of the second signal;

processing, by the circuitry, a second synchronous subtraction based on a first sample of the second signal and a second sample of the first signal;

calculating, by the circuitry, a first power based on a result of the first synchronous subtraction;

calculating, by the circuitry, a second power based on a result of the second synchronous subtraction;

calculating, by the circuitry, a first gain based on the first power and a difference between the first power and the second power;

smoothing, by the circuitry, the first gain;

processing, by the circuitry, a combined result by multiplying the first synchronous subtraction by the smoothed first gain; and outputting, by the circuitry, the combined result.

7. The sound processing method according to claim 6, wherein the first microphone and the second microphone are omnidirectional microphones.

8. The sound processing method according to claim 6, wherein the first synchronous subtraction is calculated by subtracting the second signal from the first signal in synchronization with a certain interval between a first input of a sound into the first microphone and a second input of the sound into the second microphone.

9. The sound processing method according to claim 6, wherein the second synchronous subtraction is calculated by subtracting the first signal from the second signal in synchronization with a certain interval between a first input of a sound into the first microphone and a second input of the sound into the second microphone.

10. The sound processing method according to claim 6, wherein the first microphone picks up a target sound, and the sound microphone picks up a noise prior to the target sound.

11. A non-transitory computer readable medium having a computer program recorded thereon, the computer program configured to perform a method when executed on a computer, the method comprising:

receiving a first signal from a first microphone and a second signal from a second microphone;

processing a first synchronous subtraction based on a first sample of the first signal and a second sample of the second signal;

processing a second synchronous subtraction based on a first sample of the second signal and a second sample of the first signal;

calculating a first power based on a result of the first synchronous subtraction;

calculating a second power based on a result of the second synchronous subtraction;

calculating a first gain based on the first power and a difference between the first power and the second power;

smoothing the first gain;

processing a combined result by multiplying the first synchronous subtraction by the smoothed first gain; and outputting the combined result.

12. The non-transitory computer readable medium according to claim 11, wherein the first microphone and the second microphone are omnidirectional microphones.

13. The non-transitory computer readable medium according to claim 11, wherein the first synchronous subtraction is calculated by subtracting the second signal from the first signal in synchronization with a certain interval between a first input of a sound into the first microphone and a second input of the sound into the second microphone.

14. The non-transitory computer readable medium according to claim 11, wherein the second synchronous subtraction is calculated by subtracting the first signal from the second signal in synchronization with a certain interval between a first input of a sound into the first microphone and a second input of the sound into the second microphone.

15. The non-transitory computer readable medium according to claim 11, wherein the first microphone picks up a target sound, and the sound microphone picks up a noise prior to the target sound.

* * * * *